US006666801B1

(12) United States Patent
Michalow

(10) Patent No.: US 6,666,801 B1
(45) Date of Patent: Dec. 23, 2003

(54) SPORTS SPECIFIC TRAINING METHOD AND APPARATUS

(75) Inventor: Alex Michalow, Bourbonnais, IL (US)

(73) Assignee: Acinonyx Company, Bourbonnais, IL (US)

( * ) Notice: Subject to any disclaimer, the term of this patent is extended or adjusted under 35 U.S.C. 154(b) by 321 days.

(21) Appl. No.: 09/909,531

(22) Filed: Jul. 20, 2001

Related U.S. Application Data

(63) Continuation-in-part of application No. 09/679,833, filed on Oct. 5, 2000, which is a continuation-in-part of application No. 09/435,220, filed on Nov. 5, 1999, now Pat. No. 6,482,128.

(51) Int. Cl.[7] ..... A63B 23/04
(52) U.S. Cl. ..... 482/137
(58) Field of Search ..... 482/10, 14, 100, 482/111–113, 124, 137, 140; 602/1, 23, 24, 4

(56) References Cited

U.S. PATENT DOCUMENTS

| | | | |
|---|---|---|---|
| 3,751,031 | A | 8/1973 | Yamauchi |
| 3,834,696 | A | 9/1974 | Spector |
| 3,912,265 | A | 10/1975 | Muir |
| 4,066,259 | A | 1/1978 | Brentham |
| 4,180,261 | A | 12/1979 | Kolka |
| 4,185,818 | A | 1/1980 | Brentham |
| 4,195,834 | A | 4/1980 | Lambert, Jr. |
| 4,200,279 | A | 4/1980 | Lambert, Jr. |
| 4,226,415 | A | 10/1980 | Wright |
| 4,227,689 | A | 10/1980 | Keiser |
| 4,240,627 | A | 12/1980 | Brentham |
| 4,247,098 | A | 1/1981 | Brentham |
| 4,254,949 | A | 3/1981 | Brentham |
| 4,257,593 | A | 3/1981 | Keiser |
| 4,258,913 | A | 3/1981 | Brentham |
| 4,278,249 | A | 7/1981 | Forrest |
| 4,291,787 | A | 9/1981 | Brentham |
| 4,303,239 | A | 12/1981 | Walsh, Jr. |
| 4,304,401 | A | 12/1981 | Goodman |
| 4,322,071 | A | 3/1982 | Lambert, Jr. et al. |
| 4,322,072 | A | 3/1982 | White |
| 4,326,707 | A | 4/1982 | Strecker |
| 4,355,801 | A | 10/1982 | Thomsen |
| 4,357,010 | A | 11/1982 | Telle |
| 4,358,108 | A | 11/1982 | Voris |
| 4,397,462 | A | 8/1983 | Wilmarth |
| 4,407,497 | A | 10/1983 | Gracie |
| 4,429,871 | A | 2/1984 | Flechner |
| 4,441,708 | A | 4/1984 | Brentham |
| 4,444,390 | A | 4/1984 | Erickson |

(List continued on next page.)

OTHER PUBLICATIONS

Body Master.
Flex Fitness Systems.
Hammer Strength, A Life Fitness Company, 1998.
Keiser.
King Fitness.
Life Fitness, 1995.
Magnum Fitness Systems.
Nautilus, 1999.
Paramount, 1997.
StairMaster, 1999 Catalog.
Steamline Fitness Equipment, Inc.
STRIVE.
VR Line, 1997.

*Primary Examiner*—Glenn E. Richmon
(74) *Attorney, Agent, or Firm*—Faegre & Benson LLP

(57) ABSTRACT

A method and apparatus that provides resistance to train for acceleration and the stretch-shortening cycle through a range of motion that simulates a particular sport or motion of a particular sport or activity such as running. The joint is isolated using a three contact point stabilization system. The isolated joint is trained using supra-maximal techniques designed to achieve both maximum acceleration and a minimum stretch-shortening cycle.

34 Claims, 17 Drawing Sheets

U.S. PATENT DOCUMENTS 4,448,412 A 5/1984 Brentham
4,465,274 A 8/1984 Davenport
4,478,412 A 10/1984 Muir
4,478,414 A 10/1984 Molloy
4,482,152 A 11/1984 Wolff
4,502,681 A 3/1985 Blomqvist
4,509,746 A 4/1985 Mask
4,542,900 A 9/1985 Ray
4,546,968 A 10/1985 Silberman
4,566,692 A 1/1986 Brentham
4,569,519 A 2/1986 Mattox et al.
4,600,189 A 7/1986 Olschansky et al.
4,609,190 A 9/1986 Brentham
4,621,807 A 11/1986 Stramer
4,623,143 A 11/1986 Wuellenweber
4,632,389 A 12/1986 Moss
4,651,986 A 3/1987 Wang
D289,785 S 5/1987 Lindsey
4,667,955 A 5/1987 Giesch
4,674,160 A 6/1987 Gibson
4,676,502 A 6/1987 Mahr
4,696,469 A 9/1987 Elder
4,711,448 A 12/1987 Minkow et al.
4,725,055 A 2/1988 Skowronski
4,725,056 A 2/1988 Rehrl et al.
4,726,583 A 2/1988 Olsen et al.
4,728,101 A 3/1988 King
4,732,379 A 3/1988 Bodine-Reese et al.
4,732,380 A 3/1988 Maag
4,757,992 A 7/1988 Heitsch et al.
D297,343 S 8/1988 Winston
D297,658 S 9/1988 Winston
4,776,587 A 10/1988 Carlson et al.
4,817,943 A 4/1989 Pipasik
4,836,536 A 6/1989 Jones
4,838,548 A 6/1989 Maag
4,842,271 A 6/1989 Vinciguerra
4,846,466 A 7/1989 Stima, III
4,848,739 A 7/1989 Schaub et al.
D302,713 S 8/1989 Brentham
4,863,161 A 9/1989 Telle
4,883,269 A 11/1989 Shaver
4,911,434 A 3/1990 Herring
4,919,418 A 4/1990 Miller
4,944,509 A 7/1990 Snider
4,948,122 A 8/1990 Andrews, Sr.
4,953,856 A 9/1990 Fox, III
4,979,734 A 12/1990 Sims
4,988,095 A 1/1991 Ferrari
4,997,183 A 3/1991 Winston
5,000,440 A 3/1991 Lynch
5,010,596 A 4/1991 Brown et al.
5,020,795 A 6/1991 Airy et al.
5,033,117 A 7/1991 Fairweather
5,050,589 A 9/1991 Engle
5,058,887 A 10/1991 Patterson
D321,387 S 11/1991 Jones
D321,389 S 11/1991 Jones
D321,391 S 11/1991 Jones
5,066,003 A 11/1991 Jones
5,066,004 A 11/1991 Jones
5,067,708 A 11/1991 Oschansky et al.
5,102,123 A 4/1992 Roark
5,104,119 A 4/1992 Lynch
5,110,117 A 5/1992 Fisher et al.
5,116,296 A 5/1992 Watkins et al.
5,118,100 A 6/1992 Sungaila
5,144,694 A 9/1992 Conrad Da oud et al.
5,158,520 A 10/1992 Lemke et al.
5,167,600 A 12/1992 Baird
5,167,601 A 12/1992 Frappier
5,171,196 A 12/1992 Lynch
5,171,200 A 12/1992 Jones
5,176,597 A 1/1993 Bryne
5,180,353 A 1/1993 Snyderman
5,180,354 A 1/1993 Jones
5,211,615 A 5/1993 Sides
5,222,580 A 6/1993 Wang
5,250,015 A 10/1993 Thorton
5,256,125 A 10/1993 Jones
5,273,508 A 12/1993 Jones
5,299,999 A 4/1994 Brine
5,308,304 A 5/1994 Habing
5,336,138 A 8/1994 Arjawat
5,338,274 A 8/1994 Jones
5,350,345 A 9/1994 Frey
5,352,185 A 10/1994 Blauth et al.
5,354,252 A 10/1994 Habing
5,358,468 A 10/1994 Longo et al.
5,362,297 A 11/1994 Muir
5,395,295 A 3/1995 Ish, III
5,468,202 A 11/1995 Habing
5,472,398 A 12/1995 Silverman
D365,928 S 1/1996 Sauer
5,499,962 A 3/1996 Jones
5,507,707 A 4/1996 Miller
5,509,894 A 4/1996 Mason et al.
5,514,056 A 5/1996 Ronca et al.
5,527,251 A 6/1996 Davis
5,554,084 A 9/1996 Jones
D375,823 S 11/1996 Bleiweis
5,588,940 A 12/1996 Price et al.
5,595,556 A 1/1997 Dalebout et al.
5,607,378 A * 3/1997 Winston ..... 482/105
5,725,461 A 3/1998 Bogard, II
5,803,882 A 9/1998 Habing et al.
5,846,169 A 12/1998 Tscheschlog
5,868,652 A 2/1999 Spletzer
5,897,467 A 4/1999 Habing et al.
5,931,767 A 8/1999 Morales
5,937,441 A 8/1999 Raines
D419,624 S 1/2000 Eckmann
6,039,677 A * 3/2000 Spletzer ..... 482/105
6,428,495 B1 * 8/2002 Lynott ..... 602/23

* cited by examiner

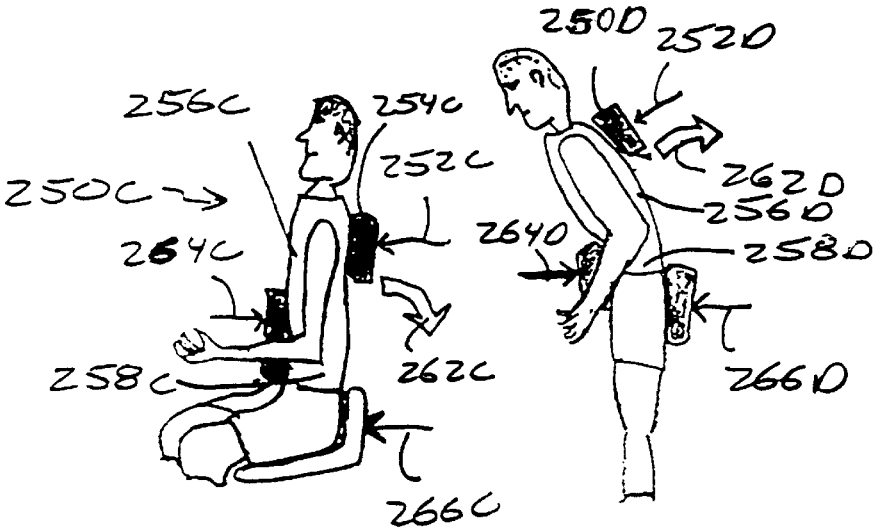
FIG. 6C
FIG. 6D
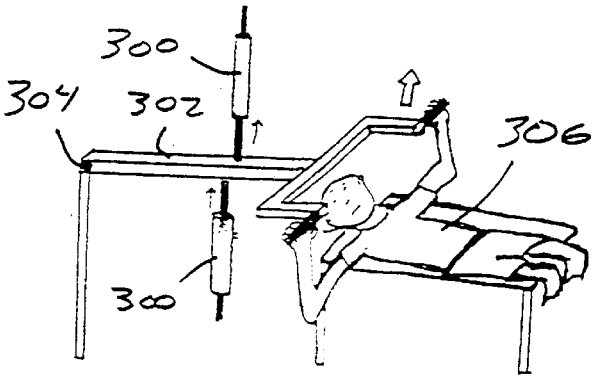
FIG. 7A
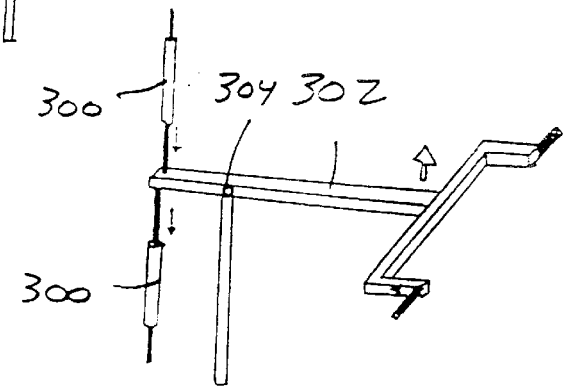
FIG. 7B

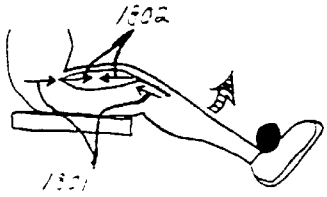
FIG. 18 A
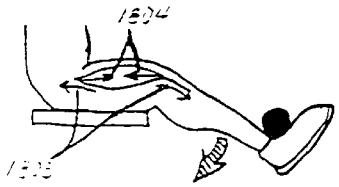
FIG. 18 B
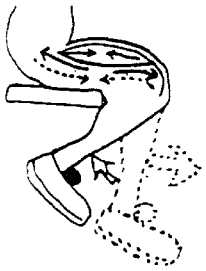
FIG. 18 C
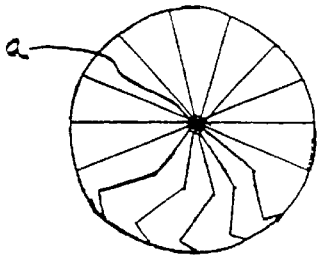
FIG. 19A
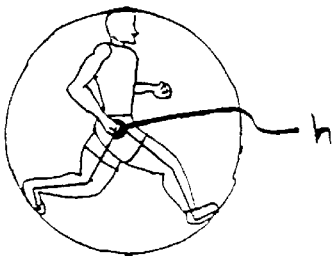
FIG. 19B
FIG. 20
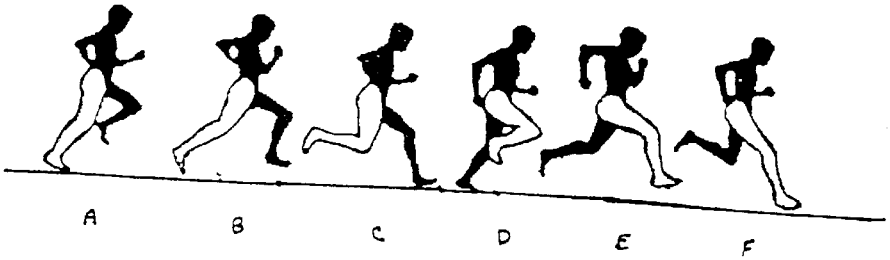
FIG. 21
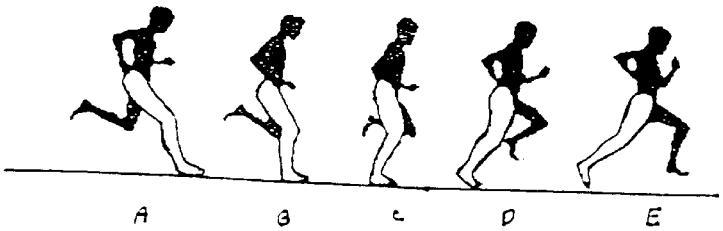

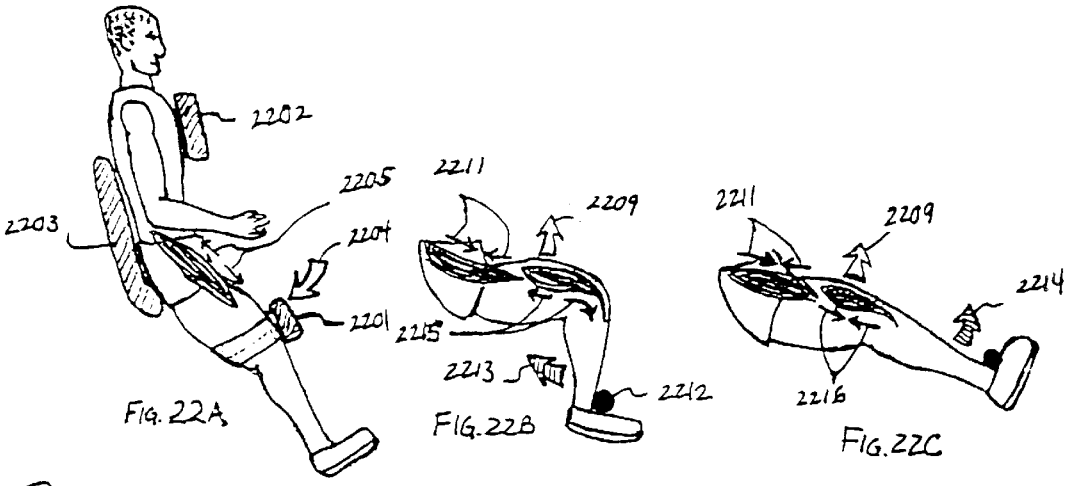
FIG. 22A
FIG. 22B
FIG. 22C
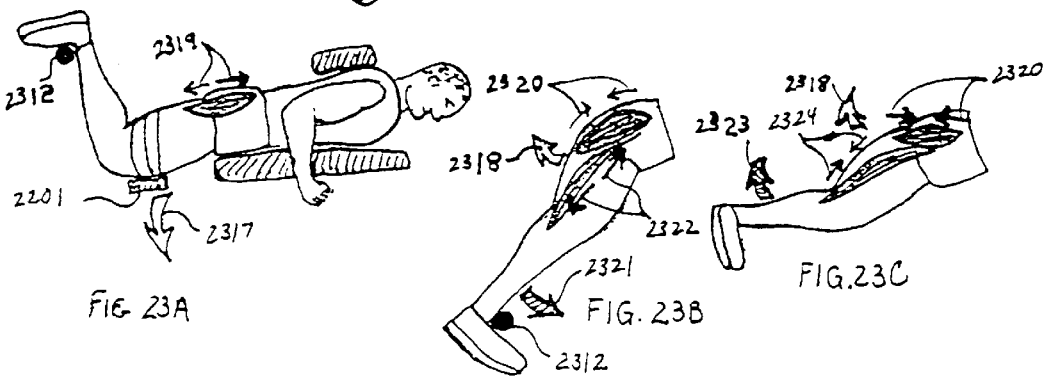
FIG. 23A
FIG. 23B
FIG. 23C
FIG. 24
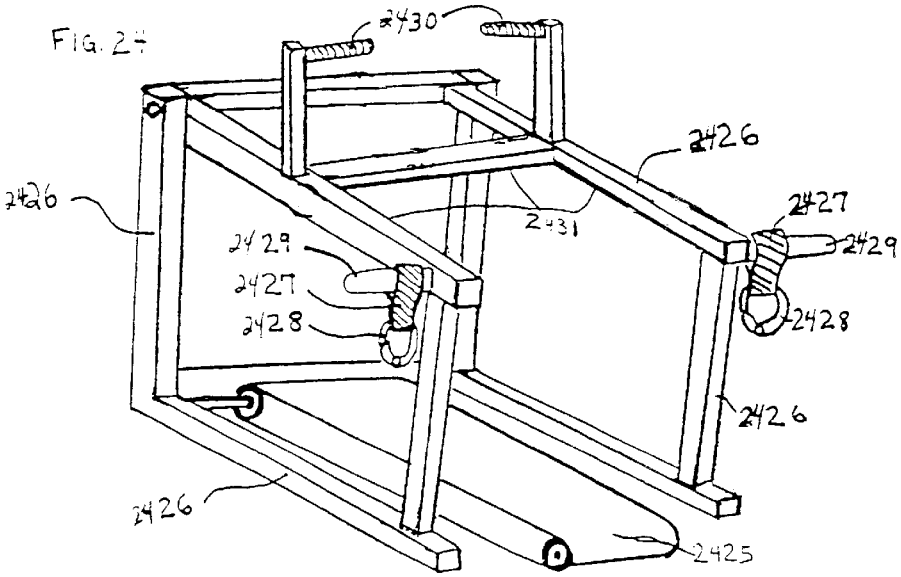

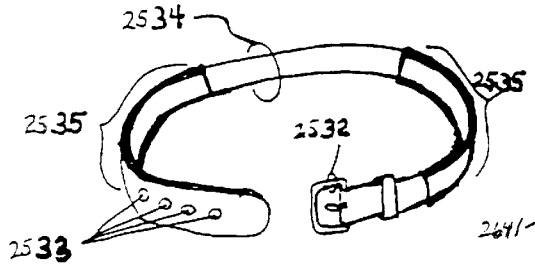
FIG. 25
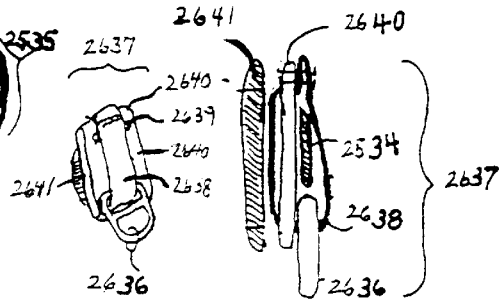
FIG. 26
FIG. 27
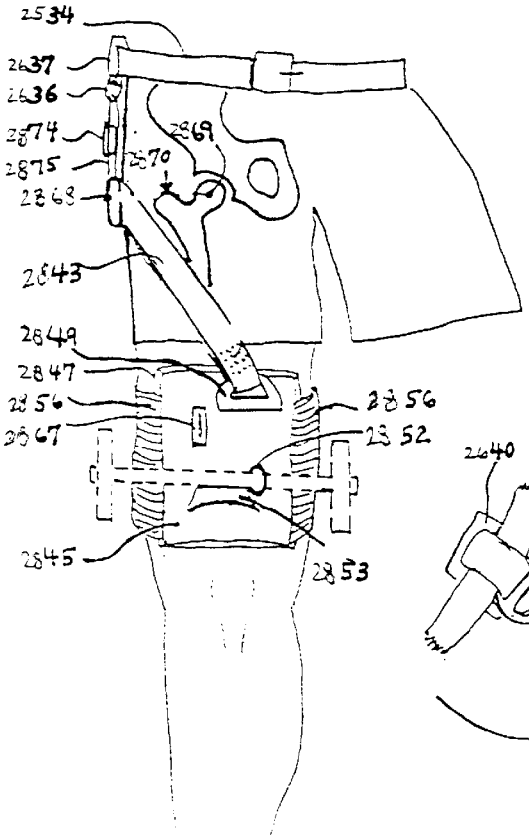
FIG. 28
FIG. 30
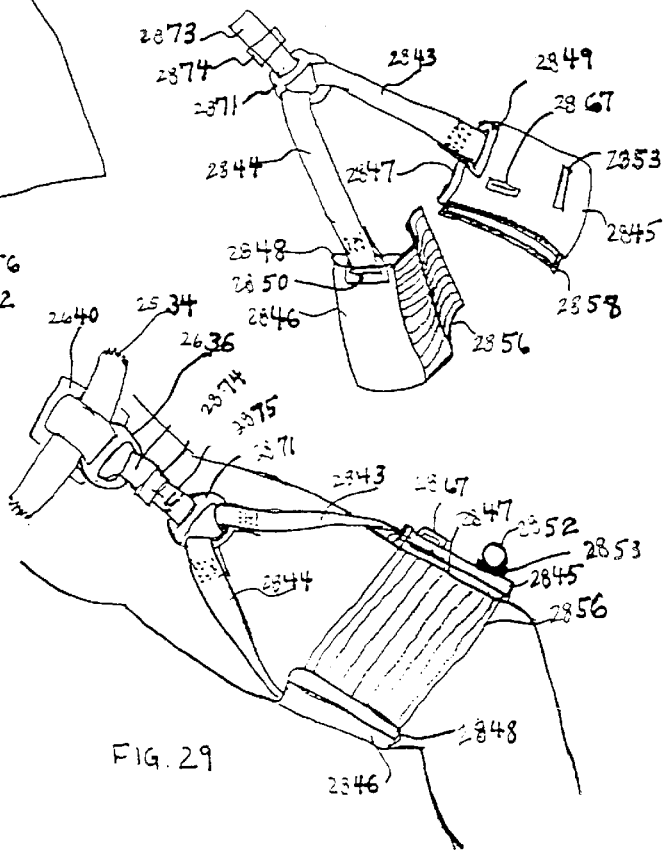
FIG. 29

SPORTS SPECIFIC TRAINING METHOD AND APPARATUS

The present application is a continuation-in-part of U.S. patent application Ser. No. 09/679,833 filed Oct. 5, 2000 which is a continuation-in-part of U.S. patent application Ser. No. 09/435,220 filed Nov. 5, 1999, U.S. Pat. No. 6,482,128.

BACKGROUND OF THE INVENTION

The present invention is directed to a method and apparatus for isolating a joint of an athlete from other joints in the body and training the isolated joint using sports specific, supra-maximal techniques designed to achieve both maximum acceleration and a minimum stretch-shortening cycle.

By increasing intensity and duration, performance of an athlete will improve up to a point. Continued training above and beyond an optimal level will produce a subsequent decline in performance due to mental and physical breakdown. This phenomenon is known as the overtraining syndrome. Therefore, if an athlete is following state of the art training philosophy and methods and is training at the threshold of overtraining, performance can only improve if the training program is improved.

For runners a training program includes both resistance training, most commonly accomplished by lifting weights, and running exercises. Resistance training involves generalized strengthening of the muscles of the lower extremity, trunk, and upper extremity. This includes exercises such as squats and leg extensions, sit-ups, bench press and biceps curls, etc. Running exercises include repeated laps of the event that is being trained for, interval training, running hills, etc.

Improvement in performance occurs with a gradual increase in intensity and duration of training. Continued training above and beyond an optimal level, however, will produce a subsequent decline in performance due to mental and physical breakdown. This phenomenon is known as the overtraining syndrome. Therefore, if an athlete is following state of the art training philosophy and methods and is training at the threshold of overtraining, performance can only improve if the training program is improved.

A training program may consist of sport specific and/or cross training exercises. Sport specific training refers to exercising in a way that mimics the motions and muscle functions, which occur during participation of a particular sport. Although cross training may improve initial performance, it is well accepted that once an athlete has reached a high level of training only sport specific methods will get him to the next level. For runners the most specific exercise that can be done is performing running exercises. However running by itself does not develop the higher degrees of power in the leg muscles necessary to progress to the next level of fitness. A sport specific training program to develop leg power for runners, thus is needed in order to progress in performance level.

Biomechanical analysis has shown that the most important muscles causing forward progress of the body in running are the hip flexors and hip extensors. Numerous hip strengthening devices have been developed. These hip training devices may be separated into those that are: 1) stationery apparatuses, where the athlete stands or lies in one place and moves the hip against a resistance mechanism, ie. cable-pulley mechanism with associated weightstack and 2) mobile, where weight is attached to the lower extremity, thereby allowing resistance training of those muscles while the athlete is actually performing a sporting activity such as running.

Since about 1970 a multitude of exercise machines have been developed with a wide variety of resistance mechanisms, including isotonic, isokinetic, pneumatic, hydraulic resistance and elastic resistance mechanisms. These machines typically are adapted to train one aspect of performance, such as acceleration or stretch-shortening. The prior art, however, fails to teach a device with adequate joint isolation adapted to train for stretch-shortening, acceleration, or both.

Acceleration training, for example, is best developed by a hydraulic resistance mechanism (pneumatic resistance being similar but less preferred due to a bounce effect at the start of a "lift"). Pneumatic devices that include a separate device for each individual joint are available from Keiser Corp. The Keiser pneumatic devices include a pump, which gives them the capability for both concentric and eccentric training.

Some hydraulic resistance exercise devices allow for both concentric and eccentric training. Most, however, give purely passive resistance, which allows for only concentric training. Some hydraulic apparatuses have been developed for cardiovascular conditioning, such as disclosed in U.S. Pat. Nos. 5,180,353 and 5,527,251.

Various weight loaded training apparatuses are available, but generally lack adequate stabilization of the surrounding body parts. The neck muscles can be trained on devices as describe in U.S. Pat. No. 4,066,259. U.S. Pat. No. 5,3366, 138 discloses-stabilization and isolation of the neck using a 2-point fixation system.

U.S. Pat. Nos. 4,725,055; 4,725,0566 and 4,836,536 disclose trunk-strengthening devices for exercising abdominal flexors and/or back extensors. These devices lack adequate stabilization and isolation of the abdominal muscles. The point of fixation below the abdomen for that patent is the thigh, which means that the hip flexors are trained along with the abdominal muscles.

Shoulder exercise devices include linear and rotating type mechanisms. Linear mechanisms are disclosed in U.S. Pat. Nos. 4,195,834; D302,713 and 5,931,767. Rotating devices are disclosed in U.S. Pat. Nos. 4,569,519; 4,757,992; D321, 387; 5,180,354; and 5,803,882. Elbow exercisers includes flexion (biceps) and extension (triceps) strengthening devices are disclosed in U.S. Pat. Nos. 5,256,125; 5,897, 467; and 5,350,345. None of these patents disclose an adequate three-point fixation system.

U.S. Pat. Nos. 4,247,098 and 5,273,508 disclose hip strengthening devices. Some hip exercise devices derive stability by placing the athlete in a recumbent position (lateral, prone or supine, depending on the manufacturer), as disclosed in U.S. Pat. Nos. 4,200,279; 4,247,098; and 5,273, 508. These devices, however, do not train the athlete in an upright manner, which would simulate a more functional and more sport specific position for the majority of athletic events. Moreover, these devices lack a fixation system adequate for isolating the desired muscles.

U.S. Pat. Nos. 4,247,098 discloses only a two-point fixation system to secure the athlete. The stretch-shortening cycle cannot be trained because there is no eccentric component in this resistance device. Although some acceleration can be trained by virtue of a hydraulic resistance device, there is no adjustable resistance mechanism as the hydraulic device here is simply a "shock-absorber" apparatus. U.S. Pat. No. 5,273,508 specifically includes use of the lower back and abdominal muscles-during training of the hip, and hence, does not isolate the desired muscles. U.S. Pat. No. 4,200,279 discloses no hip flexor training capabilities. U.S. Pat. No. 5,273,508 discloses some hip flexor strengthening capabilities, but it does not allow for single-leg training, nor does it isolate the hip muscle. Finally, these devices do not train the lower hamstring muscles, which are also important for hip extension.

Various upright hip exercising machines have been developed, such as disclosed in U.S. Pat. Nos. 4,600,189; 4,621,807; 4,711,448; 4,732,379; 5,067,708; 5,308,304; 5,354,252; 5,468,202. The main limitations of these devices are that they do not adequately stabilize the trunk of the athlete to permit isolation of the target muscles. The device disclosed in U.S. Pat. No. 4,732,379 discloses an isokinetic resistance hip exercising/testing device with a trunk pad. However, stabilization is limited to an inadequate two-point fixation system. The other patents disclose isotonic exercisers using a weight stack, and hence cannot adequately provide acceleration training. Another problem with these devices is limited vertical adjustment capabilities, which is important to properly center the hip joint during exercising for sports specific training. While the device disclosed in U.S. Pat. No. 5,067,708 has multiple vertical adjustments at the actuator, this device provides no trunk stability. Finally, the athlete is not able to train the lower hamstrings for hip extension with these devices.

U.S. Pat. No. 4,357,010 (Telle) discloses a hydraulic device where the rate of movement of the bars during lifting of the weights is maintained substantially constant by an 'isokinetic device' connected between the structure and one of the beams. The Telle device uses the hydraulic device for an isokinetic (constant speed) function to control momentum of the weights and to maintain constant velocity. Constant velocity is a sub-optimal method of training for acceleration. Telle also teaches that weights are needed to control the malingering factor that may occur when training on solely isokinetic equipment. This teaching strongly suggests that the Telle device is mainly an isotonic training apparatus, where the hydraulic/isokinetic unit is used-in conjunction with the weights to maintain constant velocity, but not alone. Additionally, the hydraulic unit of Telle is not detachable. When training stretch-shortening isotonically, the inherent friction in the hydraulic unit, even if the resistance is set at zero, lessens the eccentric load and gives sub-optimal stretch-shortening training. The device of Telle is intended to allow the performance of multiple exercises on one device, rather than for isolated joint training. Stabilization of a particular joint is not discussed. Finally, because the way in which the hydraulic unit is attached to the actuator arm (perpendicular to it), only linear types of (multiple joint) exercises are possible, not single joint rotating exercises.

Knee flexion (hamstrings) and extension (quadriceps) training devices are disclosed in U.S. Pat. Nos. 4, 502, 681; 4,732,380; 4,776,587; 5,050,589; 5,116,296. U.S. Pat. Nos. 4,502,681 and 4,776,587 use a distal thigh strap for knee stabilization, which is inadequate because optimal stabilization of the thigh for quadriceps strengthening should be at the proximal thigh near the hip joint. U.S. Pat. Nos. 4,732, 380 and 5,116,296, which are indicated for both quadriceps and hamstrings muscle training, use a mid thigh pad, which is inadequate for either of those muscles. U.S. Pat. No. 5,050,589 is a prone hamstrings training apparatus, which uses a thigh strap to stabilize it for performing hamstrings exercises. Again, adequate hamstring training requires proximal stabilization at the buttock, not at the mid-thigh, thus this stabilization is inadequate.

With regards to knee flexion (hamstrings) exercising apparatuses, there are several variations, including upright sitting, vertical standing and prone or supine lying devices. Vertical or standing hamstrings training devices disclosed in U.S. Pat. Nos. 4,322,071 and 4,358,108 demonstrate 2-point systems. The prone or supine devices disclosed in U.S. Pat. Nos. 4,509,746; 4,696,469; 4,732,380; 5,050,589; D 321, 391 and 5,066,003 for hamstrings lack adequate 3-point stability. An ankle exercising apparatus is described in U.S. Pat. No. 5,352,185, but no 3-point stabilization is disclosed.

With respect to stationery apparatuses for training the hip muscles these apparatuses place the athlete in either a recumbent or upright position. This includes U.S. Pat. Nos. 4,200,279, 4,247,098, 4,600,189, 4,621,807, 4,711,448, 4,732,379, 5,067,708, 5,273,508, 5,308,304, 5,354,252, 5,468,202 and many product catalogues such as those from Nautilus Corp., Stairmaster, Cybex, etc. All of these devices have limitations with respect to optimal power and sport specific training of the hip muscles. None of these devices use a three-point method of fixation of the hip thus they give inadequate stabilization and isolation of the hip. Second, because they are only meant to train the hip muscles neither of these apparatuses allows simultaneous knee flexion/extension training. Finally, they all have one built-in resistance mechanism, thus training by an alternate resistance is not possible.

The idea of applying weight to the thigh for training the hip muscles is not a new one. With respect to thigh weights several patents have been issued including U.S. Pat. Nos. 4,180,261, 4,303,239 and 5,868,652. U.S. Pat. Nos. 5,010, 596, and 5,033,117 disclose exercises garments (shorts) where weights are inserted into specialized pockets in the thigh area. Even though they are listed as garments, in essence these devices function exactly as do the thigh weighted devices. U.S. Pat. Nos. 4,953,856 and 5,937,441 disclose an exercise garment or suit which allows for weight attachments to numerous parts of the body including the thighs. By and large these thigh-weighted devices are used for increasing weight to the thigh to allow strengthening of the hip muscles while involved in a running activity.

Although these devices may strengthen the hip muscles, they all have significant limitations. None of these devices provide a detailed biomechanical process and/or training method by which to train the hip muscles specifically for running. Furthermore, these devices are not meant to lift a large amount of weight. Next, none of these devices is used with a stabilizing frame that isolates the hip muscles. Since adequate isolation of a muscle maximizes strength training of that muscle, the hip muscles as trained by the above devices are strengthened to a less than optimal level. Finally, the thigh weighted devices reported in the prior art do not give the athlete the capability of progressing from stationery strength training using relatively heavy weights to actual running exercises with thigh weights using a lower amount of weight.

U.S. Pat. No. 5,102,123 discloses a method for attaching a weight to a leg for exercising leg and buttock muscles. This device actually attaches a dumbbell weight to the back of the knee with the placement of one strap around the distal thigh above the knee and another strap around the proximal lower leg below the knee. The user first assumes a donkey position on both hands and knees and then performs leg thrusts. With the extra weight applied to the leg this exercise trains those muscles that extend the hip, the hamstring and gluteal muscles. One limitation of this device, because of its attachment at the knee, is that only the upper hamstrings, and not the lower hamstrings are trained. Second, these exercises may only be performed in the horizontal position because in the upright position the weight would tend to slide down the leg due to inadequate fixation to the body, thus upright or running exercises can not be performed. Third, only a small amount of weight can be attached to this device, thus full strengthening of the hip muscles is not possible. Fourth, this device is not designed to train the hip flexor muscles. Finally, the patent does not describe any sport specific training nor does it describe the use of the device with any stabilizing frames or with ankle weights.

U.S. Pat. No. 5,167,601 describes a sprinter leg muscle training device and method. This device is specifically designed to train the hip flexor muscles. It consists of an elastic cord attached to the knee (with a strap around the distal thigh above the knee and strap around the proximal lower leg below the knee) at one end and to a stationery object at the other end. The user then runs in place or on an inclined treadmill. The resistance in the cord provides for training of the hip flexor muscles. This device has several limitations. First, running is limited either to a treadmill or to running in one place. Second, heavy resistance exercises are not possible, thus adequate strengthening of the hip muscles to their ultimate capabilities is not possible. Furthermore, training the knee extensors, which act in conjunction with hip flexors during running, is not possible. Also the hip extensors are not trained. Next, because the treadmill is used for training the hip flexor muscles there is no training of the vertical component of running with this device. Finally, because the preferred method is to have a second person grasp the cord, this device is not convenient to use alone.

Numerous ankle-weighted devices have been patented in prior art. U.S. Pat. Nos. 4,623,143; 4,632,389; U.S. Pat. No. Des. 297,343; U.S. Pat. No. Des. 297,658; 4,997,183; 5,514,056 and U.S. Pat. No. Des. 419,624 all describe weights, which wrap around the ankle. Their main goal is to train the leg muscles while performing running exercises, hence are of relatively low weight. These devises are not meant for heavy resistance training. Nor are they associated with any specific training method.

U.S. Pat. No. 4,911,434 describes a weight-bearing apparatus attached around both ankles. This device may be used for some resistance training but, as described, this device is not meant for heavy resistance training of the lower extremities, for unilateral exercises or for running exercises.

U.S. Pat. No. 4,478,414 describes a strap attached around the ankle for performing exercises against an elastic band. This device is not meant for heavy resistance strength training or running exercises.

U.S. Pat. No. 4,322,072 describes a foot strap to which weights are attached for training the knee and hip muscles. Although this device is meant for "weight" training, as described, it is not meant for heavy resistance training. The strap around the Achilles tendon, subject to causing a large amount of pressure to that area, also limits how much weight may be applied. Furthermore, the weights are not stabilized and would be subject to swinging, especially if rapid stretch-shortening, or change in limb direction is done. Also, neither the knee nor hip muscles are isolated in any manner, thus training of these muscles is limited. Finally, these are not meant for running exercises.

U.S. Pat. No. 4,355,801 describes an ankle strap to which weights are attached by a loop. These weights are limited to 40 lbs. They are meant for knee extension only, hence no knee flexion strengthening is possible. Also, the manner by which the weights hang leaves them poorly secured thus excessive swinging would occur if one trained with rapid movement of the legs. Finally, this device is not meant for running exercises.

U.S. Pat. No. 5,509,894 describes a suspension method for flexion/extension exercises of the knee and hip. Being limited to passive/active range of motion exercises, it is not meant for resistance training.

Numerous waist or weight belts have been patented for use as exercise devices. These include U.S. Pat. Nos. D 289,785 and U.S. Pat. No. D 375,823. By and large these devices are attachments for increasing weight to the athlete while performing running activities. However, the added weights are custom weighted objects that attach to the waist belt. They are not meant for use with off-the-shelf weights, nor for adding weight beyond the small amount included. Furthermore, these patents do not describe the use of these devices with any sort of stabilizing frame, nor any mention of decreasing ground contact time, and no mention of any sport specific training method for running. Finally, these waist belts are not meant to attach to other thigh harnesses or weight-bearing frames.

U.S. Pat. Nos. 3,751,031 and 5,588,940 describe a waist belt and waist belt with shoulder straps from which weighted objects are attached and hang down between the legs. Because of the manner in which they hang, these devices are not meant for running exercises. Nor do these waist belts have a mechanism by which weights may attach to a thigh harness. Finally, these waist belts have no mechanism by which to attach to a weight bearing frame.

Weighted garments have been patented. These include U.S. Pat. Nos. 4,407,497; 4,953,856; 5,144,694 and 5,937,441. These generally have pockets or a mechanism by which weights can be applied to areas of the extremities for adding resistance while performing a sporting act, such as running. These devices thus, to a limited extent, can train the hip and knee flexor and extensor muscles. However, they are not capable of carrying a large amount of weight at any one joint, thus they are not meant for heavy resistance strength training of isolated joints. Finally, they are not described for use in a sport specific manner, nor with a three-point stabilizing frame. Next, with respect to the vertical component, these devices do increase vertical load by virtue of the added weights on the body. Although exercising with these suits is generally meant for use while one is involved in running activities, neither of the patents describes a sport specific manner for decreasing ground contact time, for use with a treadmill, or a surrounding stabilizing frame.

In summary, the prior art lacks an exercise device with an adequate three-point fixation system with a combined hydraulic power trainer and isotonic stretch shortening trainer suitable for practicing the method of training for both power and acceleration on a single device.

SUMMARY OF THE INVENTION

The present training method and apparatus provides resistance to train for acceleration and the stretch-shortening cycle through a range of motion that simulates a particular sport or motion of a particular sport. The joint is isolated using a three contact point isolation and stabilization system. The isolated joint is trained using supra-maximal techniques designed to achieve both maximum acceleration and a minimum stretch-shortening cycle.

In particular, this invention describes a sport specific training method, based on the biomechanics of running, to improve running speed. This includes dividing the act of running into horizontal and vertical components and strengthening muscles specific to each component separately.

Training the horizontal component of running consists first, of strengthening the hip flexor and extensor muscles. Second, focus is placed on strengthening the knee flexor and extensor muscles. Third, focus is placed on combining hip and knee strengthening exercises. This latter exercise consists, first of combining hip flexion with knee extension. Next, it consists of combining hip extension with knee flexion. All of these exercises are performed unilaterally and using a sport specific motion, one that mimics the motion, which occurs at the hip and knee during the act of running.

Sport specific training or a sports specific motion refers to actually engaging in the sport or exercising in a way that mimics the motion and muscle functions that occur during participation of a particular sport. For example, sports specific training for runners refers to a stride appropriate for the distance of the running event or a motion that simulates the stride. For baseball players, the sports specific training may involve a throwing motion.

Acceleration training refers to accelerating the portion of the body being trained in a sports specific motion as fast as possible in the early lift cycle and relaxing slightly on the return stroke. Although hydraulic resistance is preferred to train for acceleration, isometric, isokinetic, isotonic, pneumatic, or elastic resistance may also be used.

Stretch-shortening cycle training refers to allowing a weight to fall as rapidly as possible on the down stroke, focusing on stopping this motion when the starting position is reached, and with as much force as possible, converting the downward momentum of the weights to an upward direction. The stretch-shortening cycle can be trained using a cable-pulley-weight stack system, direct drive weight stacks, plate loading devices, motorized hydraulic/pneumatic devices and elastic devices such as elastic bands, coil springs, bending poles, and various other systems may be used.

Supramaximal training (or overload training) refers to exercising with loads beyond those normally incurred when engaged in the sport. Supramaximal training requires substantially complete isolation and focus on the muscle or action being trained. The stretch-shortening cycle refers to the rapid conversion of an eccentric to concentric muscle contraction (and visa versa) such as which occurs when the hip is fully flexed and then begins to extend.

Isotonic training involves moving a weight through an arc of motion. The momentum of the weight once in motion reduces the resistance. Isokinetic training involves moving a lever arm at a constant angular velocity. Resistance is only provided at the preset velocity. Consequently, both isotonic and isokinetic training are sub-optimal methods of training for strength and acceleration. Hydraulic training provides resistance at all velocities through the entire range of motion. While hydraulic training is useful for developing strength and acceleration, it is a sub-optimal methods for training the stretch-shorting cycle (the rapid conversion of an eccentric to concentric muscle contraction such as occurs when the hip is fully flexed and then begins to extend).

Isotonic resistance refers to exercising with a constant load, the simplest example being lifting weights. Due to mechanical advantage through different arcs or motion, the resistance to the user is not always constant even though the load is constant. In fact, the most common weight lifting apparatuses use variable-resistance isotonic loading. These include cable-pulley-weight stack devices, direct drive weight stack devices and plate loading systems where mechanical advantages and disadvantages are built into the systems by use of cams to provide variable resistance through the range of motion. Other examples of isotonic resistance mechanism include a weight stack with a cable and pulley mechanism, a direct drive weight stack, a plate loading device, motorized pneumatic or hydraulic resistance devices, and elastic resistance mechanisms. Hydraulic resistance refers to resistance that varies with the force applied.

In one embodiment, the resistance for training acceleration is hydraulic and the resistance for training the stretch-shortening cycle is isotonic. The combination hydraulic and isotonic resistance allows an athlete to change from completely hydraulic or completely isotonic training or any combination of the two simultaneously. The hydraulic resistance device preferably consists of either a double-acting cylinder or rotary hydraulic actuator having a control valve that permits the user to vary the resistance settings providing for a workout with varying degrees of maximum speed and acceleration. The valve may have either a set number of resistance settings or an infinite number of settings.

Various weight loading mechanisms are the preferred method for training the stretch shortening cycle. The preferred type of weight loading mechanism is a plate loading system, although any number of weight stack or weight plate designs may be used. Alternatively, an electric or motorized pneumatic, hydraulic or isokinetic device capable of converting an eccentric contraction to a concentric contraction in accordance with plyometric training principles may be used.

An hydraulic and a weight loading mechanisms are preferably both attached to each individual training apparatus. Combining the hydraulic and the weight loading apparatus on single device saves cost, space and is easier to use than two separate mechanisms. In another embodiment, a small weight can be attached to the hydraulic unit so that the return stroke is returned to the starting position without the athlete having to expend any effort.

An adjustment mechanism is provided to adjust the axis of rotation of the athlete's joint to the center of the axis of rotation of the resistance mechanism, and therefore, best simulate a sports specific motion. Electronic components can optionally be included for biofeedback to measure force production, rate of force production, maximum rate of limb motion, range of limb motion, time to peak force (acceleration), etc. Data may be stored on a computer to allow the user to follow his progress in future workouts. It would also display progress for those undergoing rehabilitation from, i.e., an injury or surgery.

The present invention is also directed to various devices that isolate individual joints (wrist, elbow, shoulder, ankle, knee and hip) and spine segments (trunk or neck) and provides the ability to train for acceleration (power) and stretch shortening (plyometric) training through a sports specific motion.

The piston from the hydraulic resistance unit may be attached in any one of several ways: (1) to the actuator arm on the same side as the user for linear types of exercises in either the compression or the tension mode; (2) to the actuator arm on the opposite side of the axis of rotation, for a linear type of exercise, in either the compression or the tension mode; (3) in line with movement of a limb for exercising an isolated joint, rotating type of exercise in either the compression or the tension mode; (4) to a lever extending from the rotating actuator axle in either the compression or the tension mode; (5) to a weight stack or weight plate mechanism in either series or parallel alignment; or (6) the use of a circular, or rotating, hydraulic actuator may be used. The present invention contemplates attaching a hydraulic resistance device to any existing weight loading apparatus using one of the six mechanisms discussed above. The hydraulic unit has the capability of being completely detached from the weight loading mechanism such that either resistance mechanism could be used separately. Specifically, (this is most important when the eccentric load of the stretch shortening cycle is being trained) this configuration is to avoid any friction on the down stroke of the weight lift, which acts to slow down this motion and lead to a less than optimal training load.

BRIEF DESCRIPTION OF THE SEVERAL VIEWS OF THE DRAWING

FIGS. 6A through 6D are schematic illustrations of an abdominal stabilization system in accordance with the present invention.

FIGS. 7A through 7F are schematic illustrations of various actuator configurations using a hydraulic resistance device in accordance with the present invention.

FIGS. 18A, 18B and 18C diagram concentric, eccentric and stretch-shortening muscle actions.

FIGS. 19A and 19B are diagrams where the spokes and the axle of a wheel are shown to be analogous to the legs and the hip joint of a runner.

FIG. 20 is a series of pictures of a runner as he progresses through the swing phase of running.

FIG. 21 is a series of pictures of a runner as he progresses through the stance phase of running.

FIGS. 22A, 22B and 22C depict the body position in a three-point fixation module, along with the sequential motions and muscle actions of the hip flexors and knee extensors that are recommended for training, as they mimic those, which occur during the act of running.

FIGS. 23A, 23B and 23C depict the body position in a three-point fixation module, along with the sequential motions and muscle actions of the hip extensors and knee flexors that are recommended for training, as they mimic those actions, which occur during the act of running.

FIG. 24 is a perspective view of a treadmill with surrounding weight-bearing frame and straps with associated ring clamps, which are meant to connect to the waist belt of the training athlete.

FIG. 25 is a drawing of a waist belt.

FIG. 26 is a perspective view of the sliding mechanism which attaches the harnesses to the waist belt.

FIG. 27 is a side view drawing of FIG. 26 sliding mechanism.

FIG. 28 is a front view of a right thigh with attached thigh harness and attached weight, waist belt and sketch of underlying hip joint, depicting the hip center of rotation.

FIG. 29 is a side view of a right thigh and attached thigh harness, waist belt sliding mechanism and hip center of rotation adjustment mechanism.

FIG. 30 is a side of the thigh harness alone, without the thigh.

DETAILED DESCRIPTION OF THE INVENTION

Figures 1A, 1B:
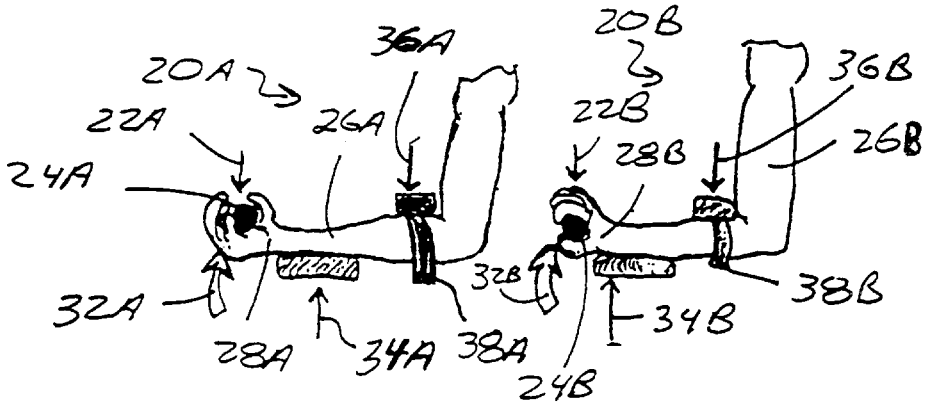
FIGS. 1A and 1B are schematic illustrations of a wrist stabilization system in accordance with the present invention.

The present invention is directed to an exercise method and apparatus for athletes, that when added to current training techniques will improve performance. Most sport activities consist of a series or sequence of joint and muscle actions. The present method involves breaking down and training the actions of each joint in the sport cycle.

It is well established that strengthening or resistance exercises are an important part of any athlete's training regimen. Sport specific training is the optimal way to train for a specific sport or activity in a sport. Sport specific training involves training muscles in such a way that mimics their function during the target activity.

In order to continue improving, the athlete needs to follow overload, or supramaximal training principles. This technique involves stressing muscles which are involved in a certain activity above and beyond the demands normally placed on them during the target event. To obtain optimal benefit from supramaximal training, muscles and/or body movements must be isolated. Furthermore, in order to completely isolate a muscle or function requires that the surrounding body parts be completely stabilized. Only when isolated and fully stabilized can the athlete place maximum focus on the target muscle.

With respect to sport specific motion, limbs as a rule don't move at constant velocity. Muscles acting at a joint cause an acceleration of the respective limb, which is followed by a deceleration. The acceleration is caused by what is called a concentric contraction. In a concentric contraction the muscle shortens when it contracts. The deceleration is accomplished by an eccentric contraction. Here the muscle lengthens as it contracts.

Eccentric contractions are associated with injuries such as tendonitis, muscle pulls and tears. When a muscle contracts, internal structures within a muscle cell shorten. If an entire muscle belly (external structure) is lengthening, as in an eccentric contraction, and at the same time the internal structures are shortening, it creates opposing forces between internal and external structures. This push-pull antagonism, if excessive, overloads the system and can thus lead to injury.

During most sporting events muscles don't simply undergo isolated concentric or eccentric contractions. Although the onset of a motion is due to a concentric contraction, which causes acceleration of a limb, most events (i.e., running, throwing) consist of a series of repeating concentric, eccentric, concentric, eccentric contractions. When the limb completes one of these eccentric contractions in the series and slowly converts to a concentric one, tension generated by the eccentric contraction is dissipated as heat. If, on the other hand, this conversion occurs rapidly, as for most sporting events, then a significant amount of the tension developed during the eccentric contraction is stored as energy, which is released in the subsequent concentric contraction. The total maximum force that can be developed by this concentric contraction is much greater than when the concentric contraction occurs alone. The rapid eccentric—concentric conversion is referred to as a stretch shortening or when repeated is referred to as the stretch shortening cycle.

Since functional activities in sports involve acceleration of a limb and stretch shortening, sports specific training requires that these two types of contractions be focused on during the training period.

Acceleration training may also be called power training. Power training refers to generating force as fast as possible. Time to peak force is more important than the absolute force generated. Power training can be accomplished by any one of a number of strength training techniques including isometric, isokinetic, isotonic, pneumatic, hydraulic, elastic, etc. Hydraulic resistance is felt to be the optimal way to train for acceleration of a limb. The other strength training techniques have limitations. Isometrics is not very specific as there is no actual limb motion. It is difficult to adapt isometrics to sports specific exercises. Isokinetic training is not physiologic because, by definition, it consists of a constant velocity, rather than the acceleration that is preferred. Resistance is provided when a preset velocity is reached, thus isokinetic systems provide no resistance at the onset of a contraction or when fatigue sets in. In addition, isokinetic systems tend to be very expensive and have found a niche in the rehabilitation arena rather than in the gym. Finally, while isotonic and elastic resistance mechanisms can be used to power train, both involve concentric and eccentric contractions, thus full focus on concentric acceleration is not possible.

Hydraulic resistance is believed to be the optimal method for acceleration training for a variety of reasons. First, it is purely concentric, which is important in being specific to the muscle's needs and also being safe and useful if there is an injury. Second, the resistance setting can be varied and is active throughout the arc of motion. The resistance once set, still varies to the athlete's effort, (it is accommodating) and allows the limb to accelerate at different rates. Fatigue does not exclude resistance. Finally, hydraulic mechanisms are cost competitive. Pneumatic devices are similar to hydraulic ones in that resistance is set by adjusting the flow of air, as opposed to fluid, through an aperture. Because air is compressible there is a certain bounce effect at the onset of contraction with pneumatic mechanisms thus they are less preferable than hydraulic ones.

The athlete also needs to train the stretch shortening cycle. A more recognized term for stretch shortening training is plyometrics. Plyometric exercises involve rapid deceleration of a mass followed almost immediately by a rapid acceleration of the mass in the opposite direction. The benefits of plyometrics are well documented in the literature and a well accepted training method amongst coaches, trainers and athletes. Commonly used plyometric exercises for the lower extremities include vertical leaps (both single and double-legged), tuck jumps, horizontal bounds (both single and double-legged), box jumps, cone jumps, etc. For the upper extremities, plyometics would include airborne push-ups, throwing and catching a medicine ball against a mini trampoline, etc.

In essence, stretch shortening may be trained by any mechanism that can rapidly convert an eccentric to a concentric contraction. This includes the use of isotonic, isokinetic, motorized hydraulic or pneumatic, and elastic resistance (e.g., elastic bands, bendable rods, springs, etc.) devices. The simplest way to train stretch shortening involves the use of dumbbells or barbells. When a weight is lifted up against gravity the muscle acting on the weight is undergoing a concentric contraction. Then when the weight is coming down, an eccentric contraction absorbs or slows this downward force. Allowing the weight to fall and rapidly converting this to an upward motion of the weight will train stretch shortening.

The use of dumbbells in this way is effective only in combination with complete isolation and stabilization of surrounding body parts. For a better understanding of stabilization, resistance-training techniques are divided into linear and rotary motions. Linear motions are those that involve a back and forth movement of a limb or the body, examples of which include bench press, military press and squat thrusts. These types of lifting motions require more than one muscle group and at least two joints. Stabilization of surrounding body parts is easily accomplished by pressing the body or legs against an immovable object. This would include the use of a padded bench or chair in the case of bench press and military press exercises and the use of the ground in the case of squat thrusts.

Rotating types of motions involve moving a limb around an axis of rotation, examples of which include arm curls, leg curls and leg extensions. Rotary motion utilizes one muscle group that acts around one specific joint, rather than the multi-joint motions that are necessary for linear motions. Stabilization of a single joint performing a rotary exercise through an arc of motion requires 3-point isolation and stabilization for optimal stability. In one embodiment, the first contact point is where the actuator meets the limb being trained distal to the axis of rotation of the joint. The actuator delivers the force to the limb or body part. The second contact point is where a support pad meets the athlete's body at or near the axis of rotation on the opposite side of the limb as the first contact point. The third contact point is where a support pad meets the athlete's body proximal the axis of rotation and on the same side of the limb as the first contact point. The neck and lumbar muscles, although they do not act at a single joint, the spine segments do combine their actions to form an isolated "joint"-like motion (they flex and extend) and thus can be stabilized in accordance with the above principles. Finally, the center of rotation of the joint being trained and the actuator axle need to be co-axially aligned.

In one embodiment, moving weights with gravity is used to train stretch shortening because it meets the requirements for eccentric to concentric conversion, it is simple to apply and is cost effective. The use of an apparatus that isolates and stabilizes each joint is required. Although a weight stack device may be used to train this type of contraction, the increased friction in the pulleys and weight stabilizing poles for cable-pulley mechanisms and the increased friction with multiple bearings in the direct drive mechanisms slows the downward movement of the weight stack, resulting in a decreased eccentric load relative to the concentric load. An apparatus using plate loading weights is the preferred type of device to train stretch shortening because the single rotating bearing at the actuator axis has less friction than these other mechanisms, giving better eccentric and stretch shortening training.

FIGS. 1A through 6D depict various three-point contact systems for the major joints and both spinal segments. The small arrows indicate the direction and location of each of the contact points discussed above needed to obtain three-point isolation and stabilization around the desired joint. As used herein, "contact point" refers to a force vector indicating both the location and the direction of a force applied to the athlete. The larger arrows indicate the direction of limb movement in opposition to the resistance of the actuator. Note that some points are best secured by a strap, others by a padded structure and some by either one.

FIG. 1A illustrates wrist stabilization system 20A for (palmar) flexion. First contact point 22A is located where the actuator 24A engages with the limb 26A being trained distal to the axis of rotation 28A of the joint. The axis of rotation 28A is located at the wrist joint. The actuator 24A provides resistance in the direction 24A as the wrist is moved in the direction 32A. The second contact point 34A is support pad located at or near the axis of rotation 28A of the joint, but on the opposite side of the limb 26A as the first contact point 22A. The third contact point 36A is support pad located proximal the axis of rotation 28A and on the same side of the limb 26A as the first contact point 22A. The support pad 36A may optionally include a strap 38A to further secure the limb being trained.

FIG. 1B illustrates wrist stabilization system 20B for extension (dorsiflexion). First contact point 22B is located where the actuator 24B engages with the wrist 26B being trained distal to the axis of rotation 28B of the joint. The axis of rotation 28B is located at the wrist joint. The actuator 24B provides resistance in the direction 22B as the wrist is moved in the direction 32B. The second contact point 34B is support pad located at or near the axis of rotation 28B of the joint, but on the opposite side of the limb 26B as the first contact point 22B. The third contact point 36B is support pad located proximal the axis of rotation 28B and on the same side of the limb 26B as the first contact point 22B. The support pad 36B may optionally include a strap 38B to further secure the limb being trained.

Figures 1C, 1D:
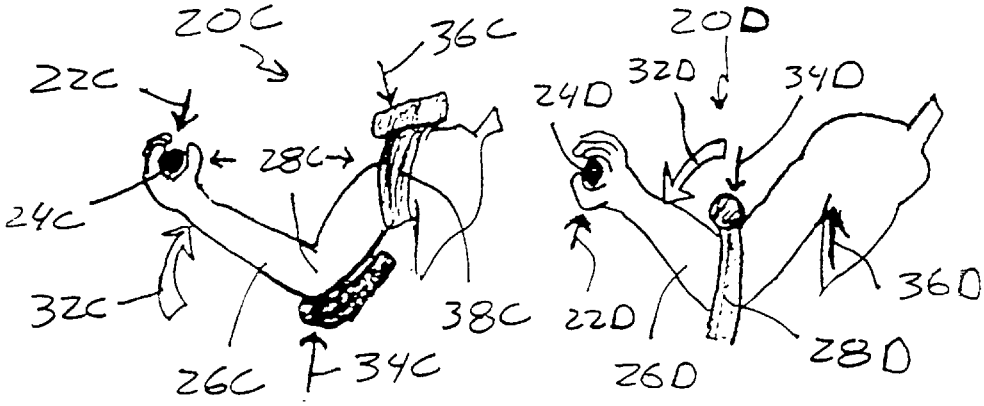
FIGS. 1C and 1D are schematic illustrations of an upper arm stabilization system in accordance with the present invention.

FIG. 1C illustrates elbow stabilization system 20C for flexion. First contact point 22C is located where the actuator 24C engages with the arm 26C being trained distal to the axis of rotation 28C of the joint. The axis of rotation 28C is located at the elbow joint. The actuator 24C provides resistance in the direction 22C as the forearm is moved in the direction 32C. The second contact point 34C is support pad located at or near the axis of rotation 28C of the joint, but on the opposite side of the limb 26C as the first contact point 22C. The third contact point 36C is a support pad located proximal the axis of rotation 28C and on the same side of the limb 26C as the first contact point 22C. The support pad 36C may optionally include a strap 38C to further secure the limb 26C being trained.

FIG. 1D illustrates elbow stabilization system 20D for extension. First contact point 22D is located where the actuator 24D engages with the arm 26D being trained distal to the axis of rotation 28D of the joint. The axis of rotation 28D is located at the elbow joint. The actuator 24D provides resistance in the direction 22D as the forearm is moved in the direction 32D. The second contact point 34D is support pad located at or near the axis of rotation 28D of the joint, but on the opposite side of the limb 26D as the first contact point 22D. The third contact point 36D is located proximal the axis of rotation 28D and on the same side of the limb 26D as the first contact point 22D. The third contact point 36D can be any of a variety of devices to secure the shoulder, such as a support pad, a shoulder strap, and the like.

Figure 2A:
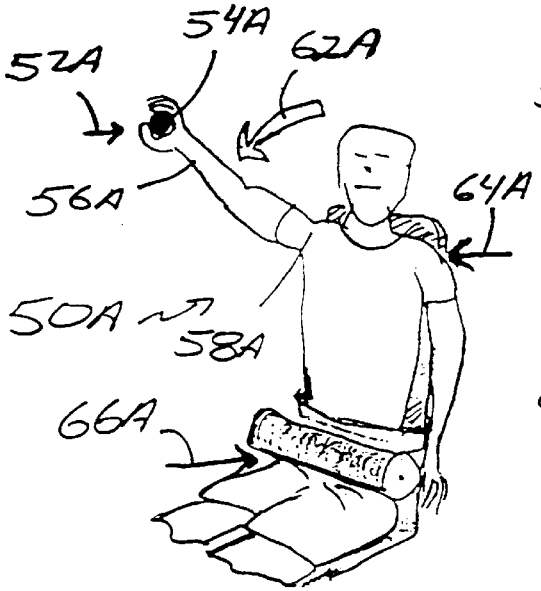
FIGS. 2A and 2B are schematic illustrations of a shoulder stabilization system in accordance with the present invention.

FIG. 2A illustrates shoulder stabilization system 50A for contraction. First contact point 52A is located where the actuator 54A engages with the arm 56A being trained distal to the axis of rotation 58A of the joint. The axis of rotation 58A is located at the shoulder joint. The actuator 54A provides resistance in the direction 52A as the arm is moved in the direction 62A. The second contact point 64A is support pad located at or near the axis of rotation 58A of the joint, but on the opposite side of the limb 56A as the first contact point 52A. The third contact point 66A is support pad located proximal the axis of rotation 58A and on the same side of the limb 56A as the first contact point 52A. The pad at the third contact point 66A is preferably engaged with the more firm bone of the front wings one on each side of the pelvis, rather than just the soft abdominal muscle alone.

Figure 2B:
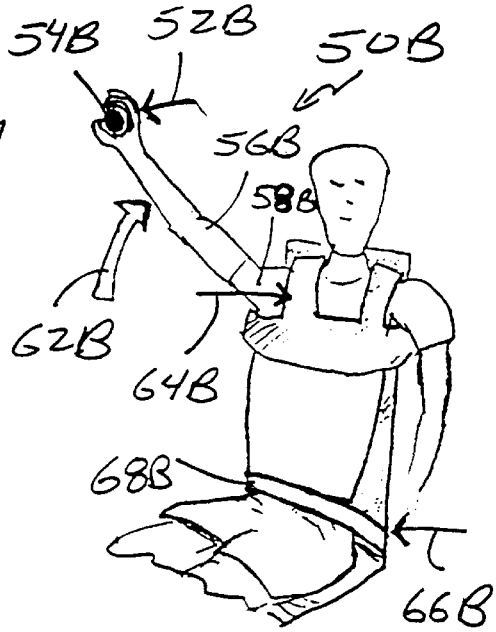

FIG. 2B illustrates shoulder stabilization system 50B for extension.

First contact point 52B is located where the actuator 54B engages with the arm 56B being trained distal to the axis of rotation 58B of the joint. The axis of rotation 58B is located at the shoulder joint. The actuator 54B provides resistance in the direction 52B as the arm is moved in the direction 62B. The second contact point 64B is support pad located at or near the axis of rotation 58B of the joint, but on the opposite side of the limb 56B as the first contact point 52B. The third contact 66B point is support pad located proximal the axis of rotation 58B and on the same side of the limb 56B as the first contact point 52B for the actuator 54B. The shoulder stabilization system SOB may optionally include a waist strap 68B to further secure the athlete being trained.

Figure 3A:
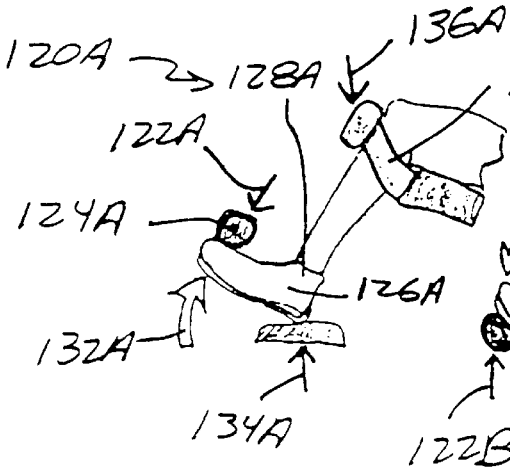
FIGS. 3A and 3B are schematic illustrations of an ankle stabilization system in accordance with the present invention.

FIG. 3A illustrates ankle stabilization system 120A for flexion. First contact point 122A is located where the actuator 124A engages with the foot 126A being trained distal to the axis of rotation 128A of the joint. The axis of rotation 128A is located at the ankle joint. The actuator 124A provides resistance in the direction 122A as the ankle is moved in the direction 132A. The second contact point 134A is support pad located at or near the axis of rotation 128A of the joint, but on the opposite side of the limb 126A as the first contact point 122A. The third contact point 136A is support pad located proximal the axis of rotation 128A and on the same side of the limb 126A as the first contact point 122A. The support pad 136A may optionally include a strap 138A to further secure the limb being trained.

Figure 3B:
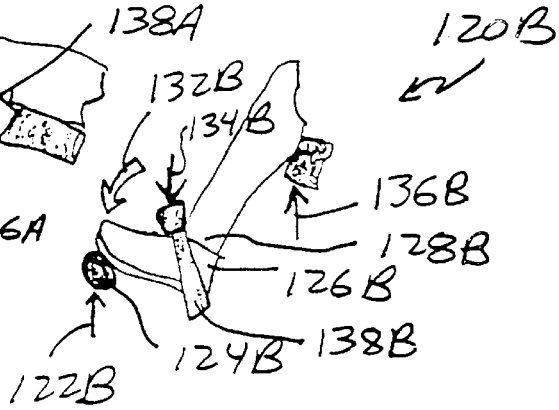

FIG. 3B illustrates ankle stabilization system 120B for extension. First contact point 122B is located where the actuator 124B engages with the foot 126B being trained distal to the axis of rotation 128B of the joint. The axis of rotation 128B is located at the ankle. The actuator 124B provides resistance in the direction 122B as the ankle is moved in the direction 132B. The second contact point 134B is support pad located at or near the axis of rotation 128B of the joint, but on the opposite side of the limb 126B as the first contact point 122B. The third contact point 136B is support pad located proximal the axis of rotation 128B and on the same side of the limb 126B as the first contact point 122B. The support pad 134B may optionally include a strap 138B to further secure the limb being trained.

Figures 4A, 4B:
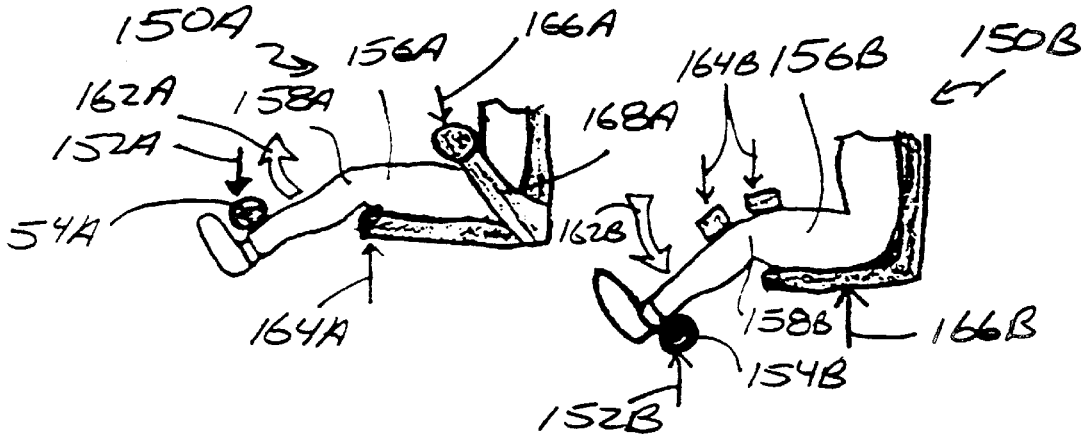
FIGS. 4A and 4B are schematic illustrations of a knee stabilization system in the sitting position in accordance with the present invention.

FIG. 4A illustrates knee stabilization system 150A for exercising the quadriceps muscles for knee extension while in the seated position. First contact point 152A is located where the actuator 154A engages with the leg 156A being trained distal to the axis of rotation 158A of the joint. The axis of rotation 158A is located at the knee. The actuator 154A provides resistance in the direction 152A as the calf is moved in the direction 162A. The second contact point 164A is support pad located at or near the axis of rotation 158A of the joint, but on the opposite side of the limb 156A as the first contact point 152A. The third contact point 166A is support pad located proximal the axis of rotation 158A and on the same side of the limb 156A as the first contact point 152A. The knee stabilization system 150A may optionally include a waist strap 168A to further secure the athlete being trained. Isolation and stabilization by the waist strap 168A at the lower abdomen is best accomplished if the pad or strap actually contacts the more firm bone of the front wings, one on each side, of the pelvis or the upper end of the femur, rather than just the soft abdominal muscle alone.

FIG. 4B illustrates knee stabilization system 150B for exercising the hamstrings muscles for knee flexion while in the seated position. First contact point 152B is located where the actuator 154B engages with the leg 156B being trained distal to the axis of rotation 158B of the joint. The axis of rotation 158B is located at the knee. The actuator 154B provides resistance in the direction 152B as the arm is moved in the direction 162B. The second contact point 164B is one or both of the support pad located at or near the axis of rotation 158B of the joint, but on the opposite side of the limb 156B as the first contact point 152B. The support pad 164B can be located above or below the patella to avoid patellar problems that may occur with direct pressure on it. Appropriate stabilization is rendered by fixing the upper thigh/hip joint, rather than the waist. The third contact point 166B is support pad located proximal the axis of rotation 158B is located on the same side of the limb 156B as the first contact point 152B. The knee stabilization system 150B may optionally include a waist strap to further secure the athlete being trained.

Figures 4C, 4D:
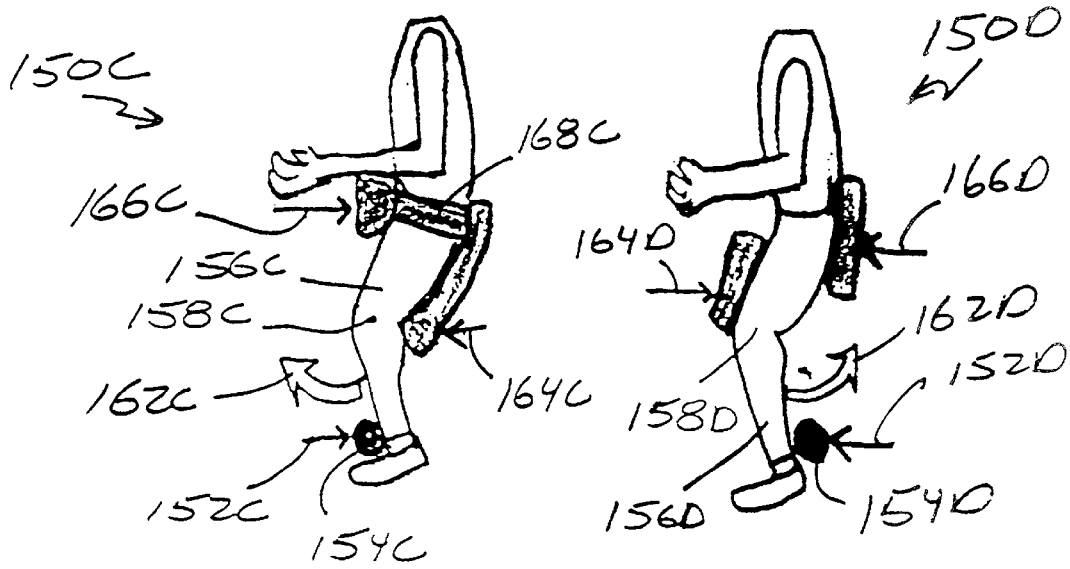
FIGS. 4C and 4D are schematic illustrations of a knee stabilization system in the standing position in accordance with the present invention.

FIG. 4C illustrates knee stabilization system 150C for exercising the quadriceps muscles for knee extension from a standing position. First contact point 152C is located where the actuator 154C engages with the leg 156C being trained distal to the axis of rotation 158C of the joint. The axis of rotation 158C is located at the knee. The actuator 154C provides resistance in the direction 152C as the calf is moved in the direction 162C. The second contact point 164C is support pad located at or near the axis of rotation 158C of the joint, but on the opposite side of the limb 156C as the first contact point 152C. The third contact point 166C is support pad located at the proximal femur and/or anterior pelvic wing proximal the axis of rotation 158C and on the same side of the limb 156C as the first contact point 152C. The knee stabilization system 150C may optionally include a waist strap 168C to further secure the athlete being trained.

FIG. 4D illustrates knee stabilization system 150D for exercising the hamstrings muscles for knee flexion from a standing position. First contact point 152D is located where the actuator 154D engages with the limb 156D being trained distal to the axis of rotation 158D of the joint. The axis of rotation 158D is located at the knee. The actuator 154D provides resistance in the direction 152D as the arm is moved in the direction 162D. The second contact point is support pad 164D located at or near the axis of rotation 158D of the joint, but on the opposite side of the limb 156D as the first contact point 152D. The third contact point is support pad 166D located at the proximal femur where actual contact is made with the back of the pelvis anywhere from its lower end (ischial tuberosity) to its upper end (top of the posterior iliac wing and sacrum) proximal the axis of rotation 158D and on the same side of the limb 156D as the first contact point 152D. By turning the athlete 90 degrees, the stabilization system 150C and 150D of FIGS. 4C and 4D may be used to strengthen hip abduction and adduction.

Figure 4E:
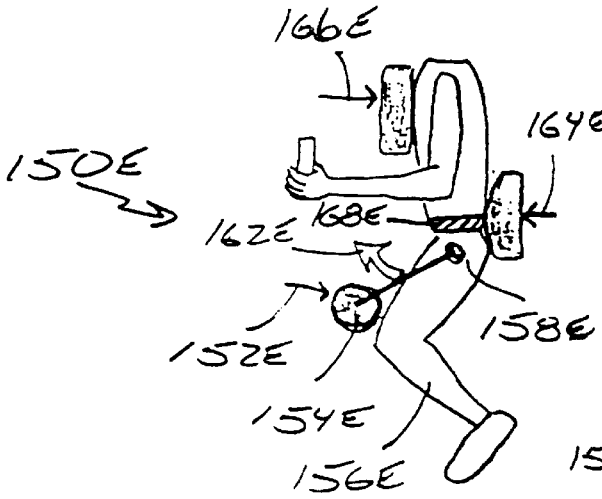
FIGS. 4E through 4H are schematic illustrations of a hip stabilization system in accordance with the present invention.
Figure 4F:
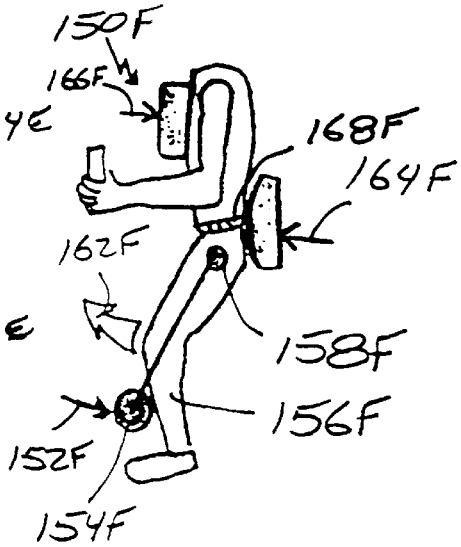

FIGS. 4E and 4F illustrate hip flexion stabilization systems 150E, 150F while in a standing position. First contact points 152E, 152F are located where the actuators 154E, 154F engage with the legs 156E, 156F being trained distal to the axes of rotation 158E, 158F of the joints. The axes of rotation 158E, 158F are located at the hips. The actuators 154E, 154F provide resistance in the directions 152E, 152F as the legs are moved in the directions 162E, 162F. The second contact points 164E, 164F are support pads located at or near the axes of rotation 158E, 158F of the joints, but on the opposite side of the limbs 156E, 156F as the first contact points 152E, 152F. The third contact points 166E, 166F are support pads located proximal the axes of rotation 158E, 158F and on the same side of the legs 156E, 156F as the first contact points 152E, 152F. The knee stabilization systems 150E, 150F may optionally include waist straps 168E, 168F to further secure the athletes being trained. By turning the body 90 degrees, the stabilization systems 150E, 150F may be used for hip abduction stabilization as illustrated in FIGS. 4G and 4H.

Figure 4G:
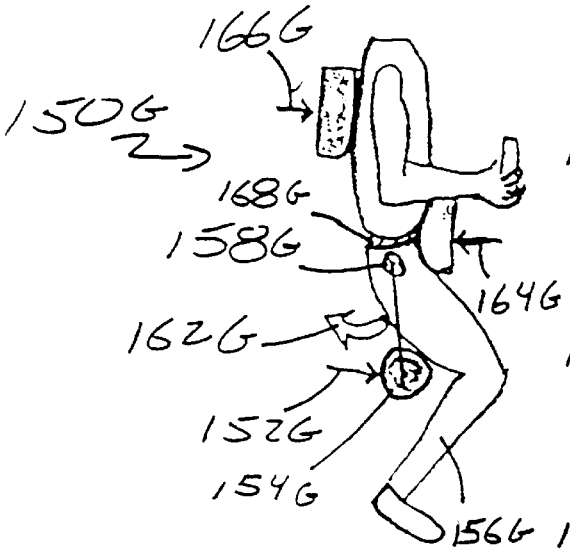
Figure 4H:
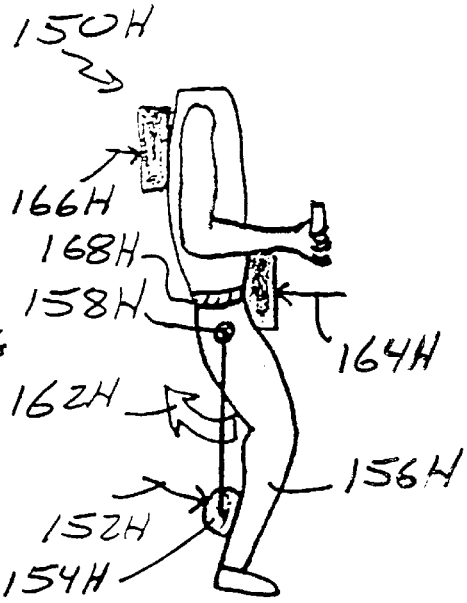

FIGS. 4G and 4H illustrate hip extension stabilization systems 150G, 150H while in a standing position. First contact points 152G, 152H are located where the actuators 154G, 154H engage with the legs 156G, 156H being trained distal to the axes of rotation 158G, 158H of the joints. As for hip flexion, contact may be above or below the knee. The axes of rotation 158G, 158H are located at the hips. The actuators 154G, 154H provide resistance in the directions 152G, 152H as the legs are moved in the directions 162G, 162H. The second contact points 164G, 164H are support pads located at or near the axes of rotation 158G, 158H of the joints, but on the opposite side of the limbs 156G, 156H as the first contact points 152G, 152H. The third contact points 166G, 166H are support pads located proximal the axes of rotation 158G, 158H and on the same side of the legs 156G, 156H as the first contact points 152G, 152H. The knee stabilization systems 150G, 150H may optionally include waist straps 168G, 168H to further secure the athletes being trained. By turning the body 90 degrees, the stabilization systems 150G, 150H may be used for hip abduction stabilization as illustrated in FIGS. 4E and 4F.

Figure 5A:
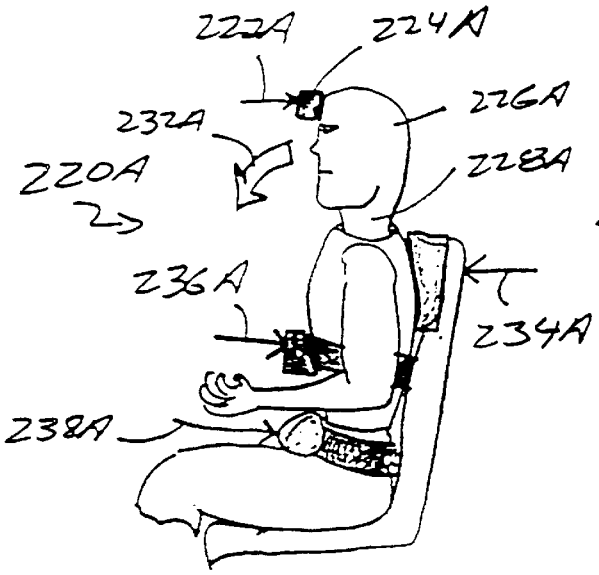
FIGS. 5A and 5B are schematic illustrations of a neck stabilization system in the sitting position in accordance with the present invention.

FIG. 5A illustrates neck stabilization system 220A for flexion. First contact point 222A is located where the actuator 224A engages with the head 226A being trained distal to the axis of rotation 228A of the joint. The axis of rotation 228A is located at the neck. The actuator 224A provides resistance in the direction 222A as the neck is moved in the direction 232A. The second contact point 234A is support pad located at or near the axis of rotation 228A of the joint, but on the opposite side of the head 226A as the first contact point 222A. The third contact point 236A is support pad located near the lower ribs/upper abdominal area, rather than the waist, such that lumbar spine flexion is avoided when training the neck. A pad only at the waist would allow simultaneous neck and abdominal flexion that is not optimal when complete isolation is preferred. The stabilization system 220A may optionally include a strap 238A to further secure the limb being trained.

Figure 5B:
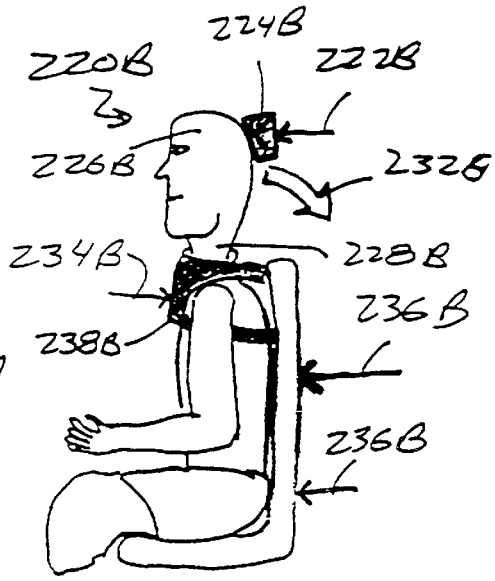

FIG. 5B illustrates neck stabilization system 220B for extension. First contact point 222B is located where the actuator 224B engages with the head 226B being trained distal to the axis of rotation 228B of the joint. The axis of rotation 228B is located at the neck. The actuator 224B provides resistance in the direction 222B as the head 226B wrist is moved in the direction 232B. The second contact point 234B is support pad located at or near the axis of rotation 228B of the neck, but on the opposite side of the limb 226B as the first contact point 222B. The third contact point 236B is a support pad located proximal the axis of rotation 228B and on the same side of the head 226B as the first contact point 222B. A shoulder harness 238B may optionally be included to further stabilize the athlete.

Figure 6A:
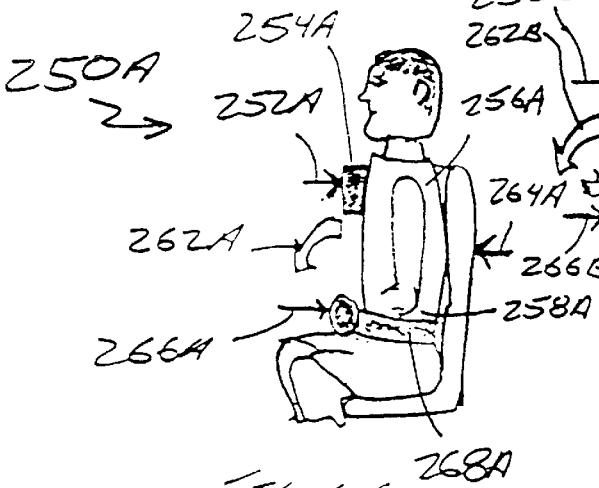
Figure 6B:
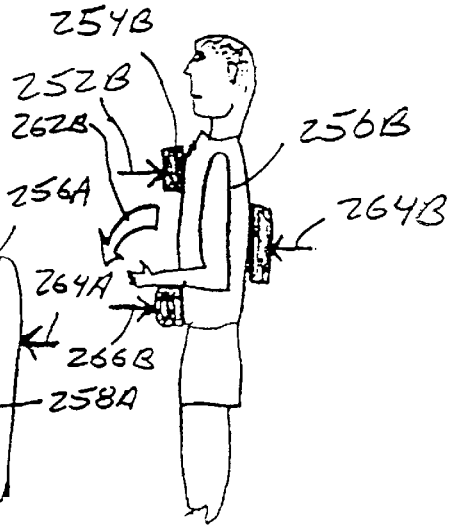

FIG. 6A illustrates stabilization system 250A for abdominal flexion training in a sitting position. FIG. 6B shows a similar stabilization system for the abdominal muscles in a standing position. The reference numbers used are the same except for the letter suffix, although the contact points may vary slightly. An important concept for abdominal flexion isolation is that the hip flexor muscles need to be excluded. Prior art that places a pad or strap around the thighs or legs does not exclude the hip flexors. In order to isolate completely the abdominal muscles requires that the stabilization occurs at the pelvis, or, more precisely, the anterior spines of the wings of the pelvis. First contact point 252A is located where the actuator 254A engages with the torso 256A distal to the axis of rotation 258A of the abdominal muscles. The axis of rotation 258A is located at the waist. The actuator 254A provides resistance in the direction 252A as the torso is moved in the direction 262A. The second contact point 264A is support pad located at or near the axis of rotation 258A, but on the opposite side of the torso 256A as the first contact point 252A. The third contact point 266A is support pad located proximal the axis of rotation 258A and on the same side of the torso 256A as the first contact point 252A. The abdominal stabilization system 250A may optionally include a waist strap 268A to further secure the athlete being trained. Isolation and stabilization by the waist strap 268A at the lower abdomen is best accomplished if the pad or strap actually contacts the more firm bone of the front wings, one on each side, of the pelvis, rather than just the soft abdominal muscle alone.

FIG. 6C illustrates stabilization system 250C for back extension in a sitting position. FIG. 6D shows the stabilization system 250D used for the abdominal muscles in a standing position. The reference numbers used are the same except for the letter suffix, although the contact points may vary slightly. First contact point 252A is located where the actuator 254A engaged with the torso 256A distal to the axis of rotation 258A of the abdominal muscles. The axis of rotation 258A is located at the waist. The actuator 254A provides resistance in the direction 252A as the torso is moved in the direction 262A. The second contact point 264C is support pad located at or near the axis of rotation 258A, but on the opposite side of the torso 256A as the first contact point 252A. The third contact point 266C is support pad located in the sacrum/pelvis area, rather than at the upper thigh, proximal the axis of rotation 258A and on the same side of the torso 256A as the first contact point 252A. The abdominal stabilization system 250A may optionally include a waist strap to further secure the athlete being trained.

Figure 7C:
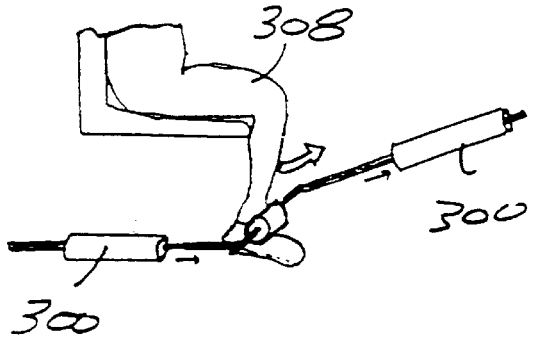
Figure 7D:
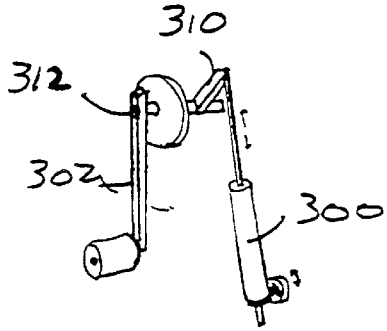
Figure 7E:
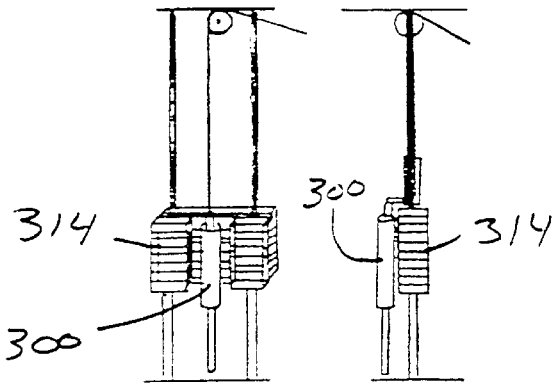
Figure 7F:
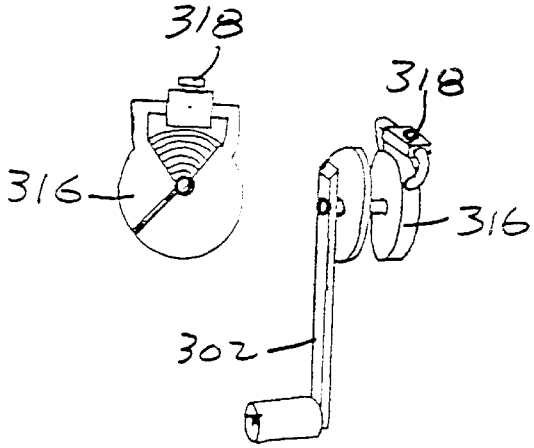

FIGS. 7A–7F illustrate six different configurations for attaching a hydraulic unit to an exercising apparatus in order to obtain this type of resistance for training for acceleration. In FIG. 7A, one or more hydraulic resistance units 300 are attached to the actuator arm 302 on the same side of the axis of rotation 304 as the athlete 306 for linear types of exercises in either the compression or the tension mode. In FIG. 7B, the hydraulic resistance units 300 are on the opposite side of the axis of rotation 304 as the athlete (not shown) for a linear type of exercise, in either the compression or the tension mode. In FIG. 7C, the hydraulic resistance units 300 are located in line with movement of a limb 308 for exercising an isolated joint in a rotating type of exercise in either the compression or the tension mode. In FIG. 7D, the hydraulic resistance unit 300 is attached to a lever 310 that extends from the rotating actuator 302 at axle 312 for use in either the compression or the tension mode. In FIG. 7E, the hydraulic resistance unit 300 is attached in either parallel or series with a weight stack 314. In FIG. 7F, the actuator arm 302 is attached to a circular hydraulic resistance unit 316. One or more valves 318 are provided on the circular hydraulic resistance unit 316 to vary resistance. The present invention contemplates attaching the hydraulic resistance device 300 or 316 to any existing weight loading apparatus using one of the six mechanisms discussed above.

Figure 8:
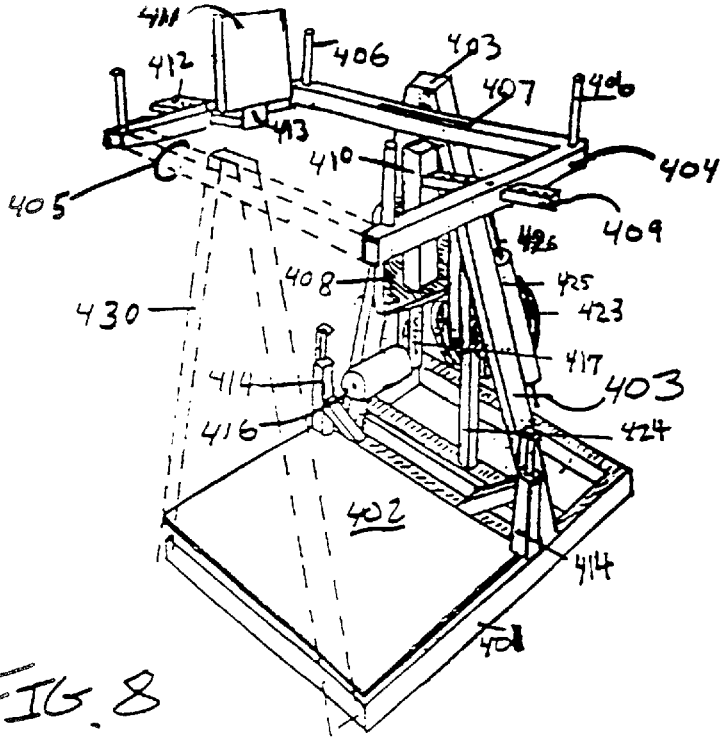
FIGS. 8 through 13 are perspective views of an exemplary hip training device in accordance with the present invention.

FIGS. 8–13 are directed to an exercise device for training hip flexion and extension in accordance with the present invention. FIG. 8 illustrates a base frame 401 with two sections. One section is roughly a square and has a standing platform 402. The second section is a rectangular shaped area separated from the standing platform 402 by an inverted V-frame 403. Attached to this V-frame 403 is a three-sided rectangular shaped frame 404. The frame 404 may be converted to a four-sided one if the connecting bar 405 is included. When the athlete stands on the platform 402, he is stabilized by the frame 404 or 405. There are four handles 406 for grasping onto. On each side, between the front and back handles one may place a forearm pad 407 (see FIG. 11).

With respect to the three points of-isolation and stabilization system, as discussed above, the first contact point is the contact point of the distal limb to the pad 416 of the actuator arm 417. The pad 416 can slide along the arm 417 by a telescoping tube mechanism 418. The actuator arm 417 attaches to the rotary actuator 419, which has multiple holes for pin-in-hole setting of the actuator arm's 417 starting position. The rotary actuator 419 attaches to the inverted V 403 frame through its axle 420. The axle 420 attaches to a cross-bar between vertical arms of the V frame 403, by a ball-bearing mechanism, (not shown in the drawings).

The second contact point is either the lower back at the sacrum (for hip flexion training) or the front of the pelvis (for hip extension training). This is depicted by pad 408. To allow for horizontal and vertical adjustment, in order to align properly the hip, there are both horizontal 409 and vertical 410 sliding bars with pin-in-hole settings.

The third contact point of stabilization is depicted by pad 411, which is attached to the frame 404 by virtue of a horizontal bar 412. Similar to bars 409 and 410 for pad 408, the horizontal 412 and vertical 413 bars for pad 411 have sliding characteristics for adjustment with pin-in-hole settings. Further positioning of the user is provided by vertical adjustment control of the standing platform. This consists of pneumatic cylinders 414 on each side along with a pin-in-hole mechanism having multiple settings 415 (See FIG. 13), to allow for a wide variety of user heights.

On the other side of the V frame 403, the axle 420 is attached to the weight bearing lever arm 421 (see FIG. 10), where a perpendicular rod placed distally 422 accepts weighted plates 423. These plates are stabilized at their starting position, which is directly downward, by a stop mechanism 424. This can be moved onto either side of the weight plate, depending on the direction of movement of the weights (the mechanism for moving the stop mechanism 424 is not shown in the drawings).

Figure 9:
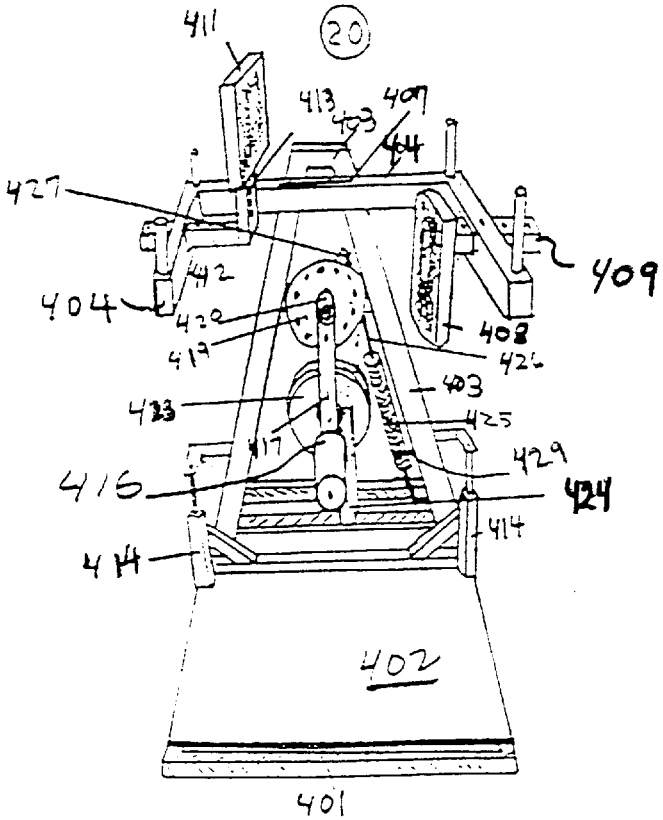
Figure 11:
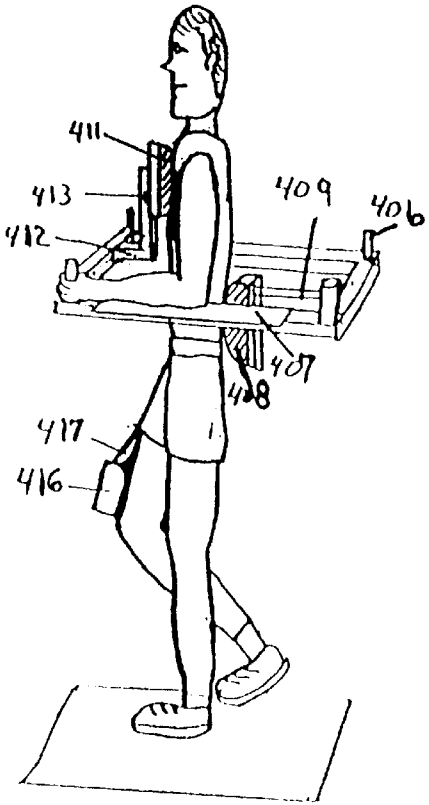
Figure 10:
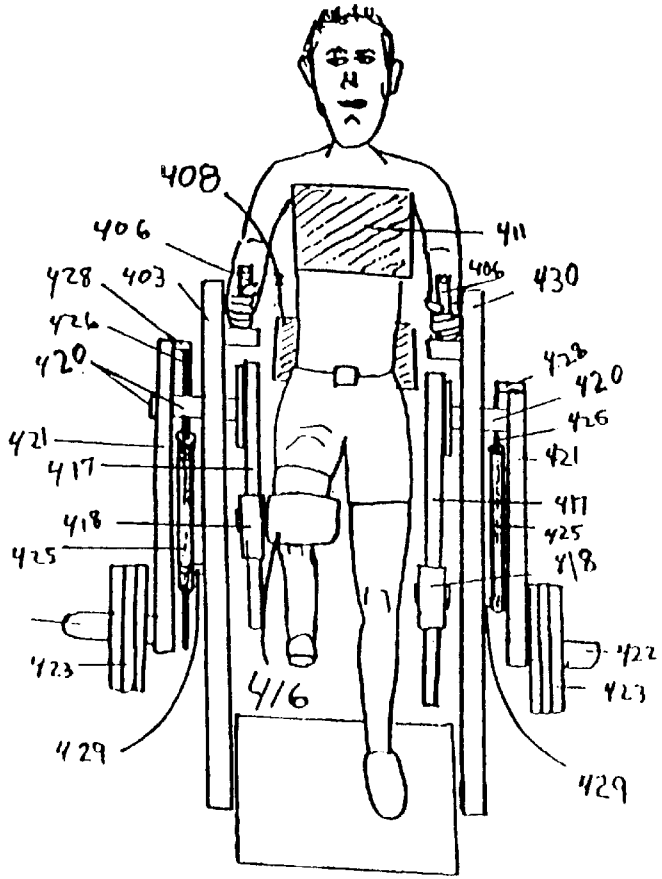
Figure 13:
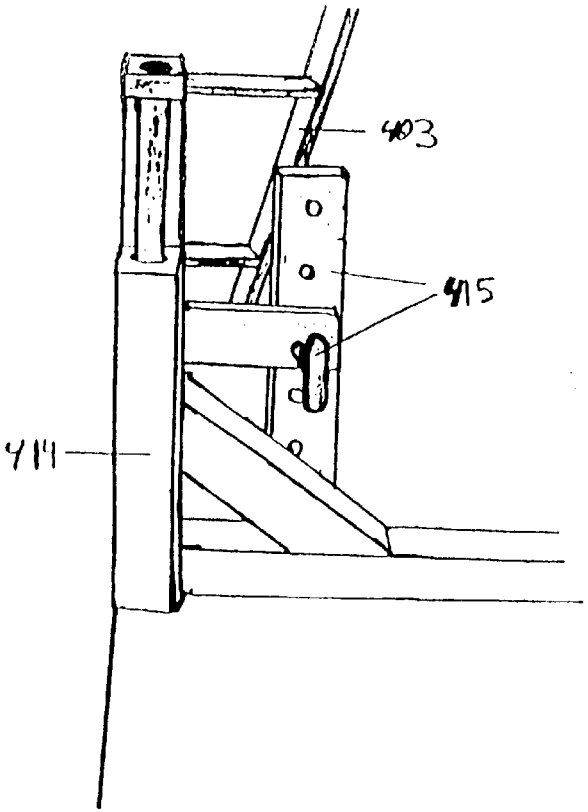
Figure 12:
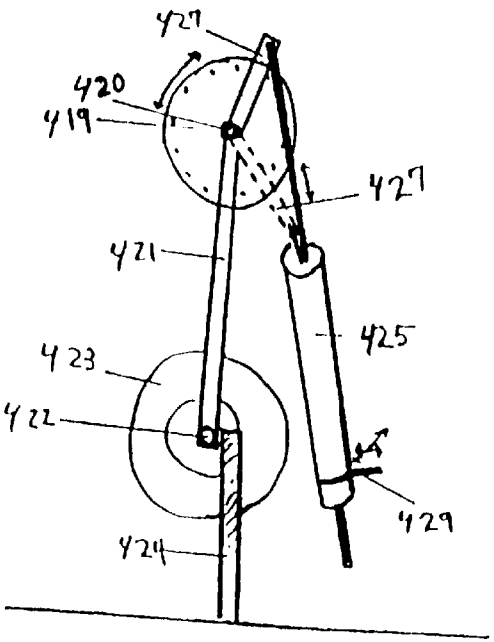

A hydraulic cylinder 425 is attached to the rotary actuator axle 420 by its piston 426. The piston 426 attaches to the axle 420, either through a separate lever 427 (see FIG. 9 and 12) or to an extension of the weight plate attachment 428, which is depicted in FIG. 10. The cylinder 425 attaches to the V frame by a mechanism that allows limitless flexion/extension or sideways motion at the attachment site 429. FIGS. 8, 9 and 10, as demonstrated, suggest that the athlete faces only one direction when training in the apparatus, forward.

The embodiment of FIGS. 8–13 includes several options: (1) a separate apparatus each for right hip flexion, left hip flexion, right hip extension and left hip extension; (2) a separate apparatuses for right hip flexion and left hip extension, and a mirror-image one for the opposite motions; (3) an apparatus as in FIG. 10 where right or left hip flexion can be trained on one apparatus; and (4) one unit that is able to train all four motions, bilateral hip flexion and extension. A second apparatus can optionally be made solely for right and left hip extension. These last two options require mirror image weight bearing and hydraulic units as in FIG. 10. The "left" side, if completed in FIG. 8, would consist of the dotted-line inverted V frame 430, to which would attach a mirror image of all of the R sided elements that are connected to the V frame 403. Finally, a rotary hydraulic actuator may be attached to the actuator axle in place of the hydraulic cylincer.

Figure 14:
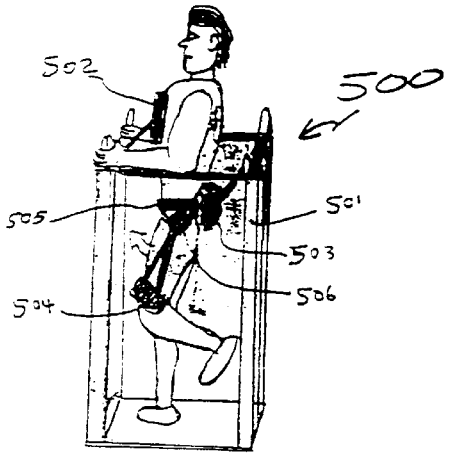
FIG. 14 is a schematic illustration of an alternate isolation system in accordance with the present invention.

FIG. 14 schematically depicts an alternate stabilization system 500 for hip and knee strengthening. Upper torso stabilization pad 502 and lower torso stabilization pad 503 are mounted on isolation frame 501. In the illustrated embodiment, the resistance mechanism is a set of weights 504 attached to waste belt 505 by a hinged axis 506. As illustrated, the hip flexors are being trained. By turning the athlete 180 degrees and shifting the weights, appropriate hip extension may also be trained.

Figure 15:
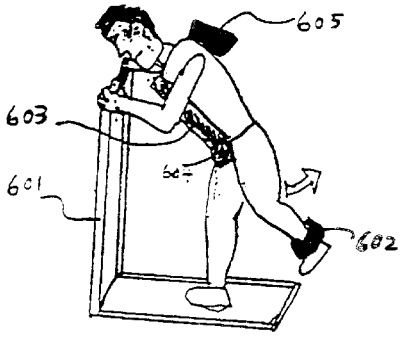
FIG. 15 is a schematic illustration of an alternate isolation system for a semi-prone position.

FIG. 15 schematically depicts a frame 601 where an athlete is in a semi-prone position. An ankle weight 602 is used for resistance. Alternatively, a weight can be attached to the thigh of the athlete using the waist belt 505 of FIG. 14. Stabilization is provided by a torso pad 603 with a rounded edge 604 as the second fixation point. An upper torso pad 605 attached to the frame 601 provides the third fixation point. Alternatively, the athlete can turn around in a semi-prone position in order to train the hip flexors.

Figure 16:
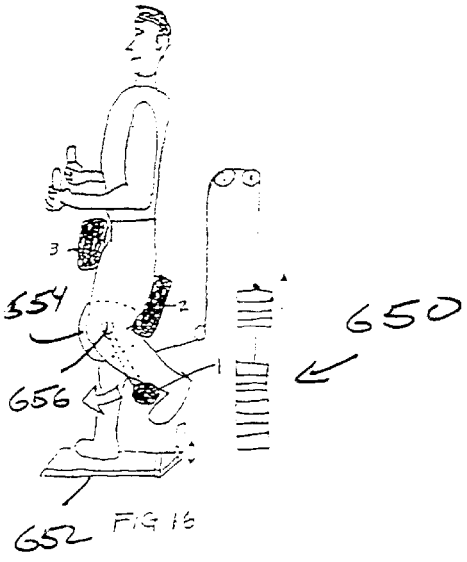
FIGS. 16 and 17 are schematic illustration of a selectorized weight stack used for knee extension and flexion.
Figure 17:
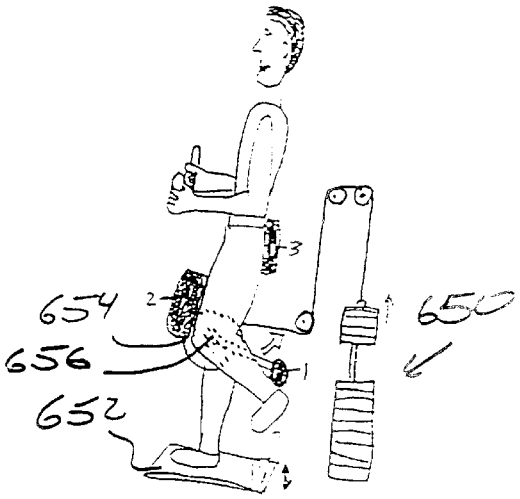

FIGS. 16 and 17 schematically illustrate a selectorized weight stack resistance mechanism 650 for upright knee extension and upright knee flexion training, respectively. The three point stabilization system is substantially as shown in FIGS. 4C and 4D. The standing platform 652 has vertical adjustment capabilities to center the axis of rotation of the knee 654 with the axis of rotation of the actuator 656. Alternatively, the standing platform 652 may be stationary with vertical adjustment capabilities at the actuator 656.

Use of the Hip Flexion/Extension Device

Biomechanical analysis demonstrates that the primary muscles functioning in the horizontal component of running (forward propulsion) are the hip flexors (iliopsoas and rectus femoris), in association with hip extensors (gluteus maximus and hamstrings). The hip flexors in close association with the hip extensors are the major muscles that cause forward propulsion. To run faster, forward propulsion needs to be improved. Hence, the primary focus in training is placed on these muscle groups, especially the hip flexors. Due to a necessity to maintain muscle balance, the hip extensors are felt to be equally important in training.

The modes of contraction that need to be focused on for training these muscles are concentric (acceleration and power) and the eccentric-concentric conversion (stretch-shortening cycle). These two modes are of primary consideration because running is really a series of accelerations and decelerations. Concentric training for power improves forward acceleration of limbs. Training the stretch-shortening cycle gives muscles the capability of decelerating the rapid limb movement caused by the concentric contraction. Furthermore, training the stretch-shortening cycle in rapid fashion trains the muscles to absorb energy during the stretch phase in order to be released immediately in the subsequent concentric phase.

In order to understand better the present method and apparatus, two concepts defined above are stressed 1) supramaximal training and 2) sport specificity. Supramaximal training is of the utmost importance because it is the only way that a well-trained athlete can hope to improve performance. Supramaximal training involves stressing muscles that are involved in a certain activity above and beyond the demands normally placed on them during that activity. To obtain the optimal benefit from supramaximal training, muscles and/or body movements must be isolated. Only when isolated can the athlete place maximum focus on that muscle. Finally, it is well known that the acidic state which occurs intracellularly in muscles undergoing intense activity leads to impaired contracitility, hence fatigue. Supramaximal training enhances a muscle's buffering capacity, thus prolonging time to fatigue. This type of training adapts the muscle in a way that improves its ability to exercise despite low intracellular pH.

Sport specific means exercising muscles in a way that they are used during a particular activity, such that runners run, swimmers swim, etc. For runners, sports specific training refers to a stride appropriate for the distance of the event or a motion that simulates the appropriate stride. The opposite of sport specific training is crosstraining. Although there is a place for crosstraining in an athlete's overall program, crosstraining will not improve a well-trained athlete's performance in the target event. The training method of the present invention is a running specific weight training method.

In order to train supramaximally, the muscles involved must be completely isolated and the rest of the body must be completely stabilized. By completely isolating the hip joint and completely stabilizing the torso, the present apparatus allows these muscles to be trained supramaximally. Supramaximal training is absolutely necessary when the goal is to optimize strength gains, especially if the athlete has plateaued. The present apparatus fully stabilizes the torso in an upright fashion with a three point stabilization system. For training the hip abductors and hip adductors, the athlete's body is turned 90° with respect to the horizontal component training apparatus.

The training device of FIGS. 8–13 has the ability to isolate hip flexors and extensors (as well as the hip abductors and hip adductors) in the upright position while stabilizing the torso using a three point stabilization system and the ability to train with either isotonic or hydraulic resistance, or both. This combination of features permits supramaximal training of the hip muscles. In the preferred embodiment, training the stretch-shortening cycle is done isotonically and training for acceleration (and power) is done using hydraulic resistance.

Muscles involved in the vertical component are the quadriceps and calf (gastrocnemius and soleus) muscles. These muscles contract in an eccentric fashion at ground contact to absorb ground reaction forces. The quadriceps are the muscles which have received the greatest amount of attention in the literature. From a biomechanic viewpoint, in the vertical plane of running, the two muscle groups (quadriceps and calf muscles) function simultaneously. If too much focus is placed on the quadriceps over the calf muscles, an imbalance will develop. For example, overtraining the quadriceps gives rise to an increased incidence of hamstring injuries. Similarly, overtraining the quadriceps over the calf muscles gives rise to increased injuries. Since the Achilles tendon plays a significant role in force absorption and release in conjunction with the calf muscles, one cause for the relatively high incidence of Achilles injuries in sprinting (i.e. tendonitis) may be the result of overtraining the quadriceps relative to the calf muscles. A device for training the vertical component is disclosed in co-pending U.S. Pat. Ser. No. 09/435,220 filed Nov. 5, 1999, entitled "Run Specific Training Method and Apparatus."

The number of repetitions done by the athlete is determined by which race is to be run. For example, a 100 meter sprinter would perform 15–20 repetitions (a sprinter, once at full speed, takes 3–4 steps per 10 meters distance, thus each leg goes through 15–20 cycles in a 100 meter race) as rapidly as possible for both resistance mechanisms. Instead of counting repetitions, the athlete can also train based on expected time for a race. For example, a 100 meter sprinter trains as rapidly as possible for 10–12 seconds and a 400 meter sprinter trains for 50 to 60 seconds, although some pacing would be needed here.

The starting position for both training types should be varied. For hip flexion strengthening, a sprinter should concentrate on performing these exercises with relatively less total hip extension (i.e., less than zero degrees extension (zero is when the leg is completely vertical) because the elite sprinter runs a race with hip range of motion of about 20 degrees to about 90 degrees. For hip extension training, the starting point should approximate 90 degrees of flexion, as this is the amount of flexion that occurs with sprinting. Also for hip extension training with both calf and thigh pad resistance should be done in order to include lower hamstrings training.

Hip and knee muscles are preferably strengthened by performing the above exercises on a frame that gives three-point stabilization to the torso and upper body. Embodiments of the invention herein allow for multiple adjustments of the frame. This includes capabilities to alter the angle of recumbence and to adjust placement of the pads, such that they may be fit for use by a large variety of user sizes.

Stationery resistance exercises for hip muscle strengthening are preferably performed using weights attached to the distal thigh. This includes the use of a thigh harness to which the weights are attached. Embodiments of this invention include the capability of attaching dumbbells, plated weights and/or customized weights to the thigh harness. Other embodiments of this invention allow for the attachment of an alternative resistance mechanism to the thigh harness.

In some embodiments of this invention the thigh harnesses have the capability to adjust the distance from the waist to the center of hip rotation. Also, an embodiment herein includes the ability to adjust the distal portion of the thigh harness to fit a wide variation of thigh sizes or circumferences.

The thigh harnesses are preferably attached to a waist belt so as to stabilize the weights at the distal thigh in order to prevent them from sliding down the leg due to gravity.

Stationery resistance exercises for knee flexor and extensor strengthening are preferably performed using weight attached to the distal lower leg at the level of the ankle. This includes the use of an ankle strap to which the weights are attached. Embodiments of this invention include the capability of attaching dumbbells, plated weights and/or customized weights to the ankle strap. Other embodiments herein allow for the attachment of an alternative resistance mechanism to the ankle strap.

Thigh and ankle devices include the use of a rigid outer shell and a cushioned inner portion. The outer shell contacts the metal dumbbells or weighted plates thereby preventing pressure, and pain, on the underlying skin and muscles. Embodiments of this invention include the use of foam padding, pressure distributing material or any other appropriate cushioning material as the inner portion.

The front thigh plate and pad be contoured in a partially circular shape to conform to the roundness of the thigh, and the front ankle plate and pad have an "L" shape to conform to the shape of the ankle when the foot is flexed at 90 degrees.

Weights for the thigh and ankle are attached in such a manner so as to prevent any swinging of the weights as the leg moves back and forth. Embodiment of this invention includes the option of placing them on either the dorsal, ventral or collateral aspects of the thigh and/or lower leg.

Following the stationery strengthening exercises the athlete perform running exercises. Running exercises are performed using relatively light weights attached to the distal thigh or at the ankle level. Embodiments of this invention include the ability to attach either off-the-shelf weighted plates or customized weighted objects. Other embodiments further include weights secured in such a fashion so that they do not bounce around while the athlete is in the act of running.

For running exercises with a distal thigh weight applied, the object is to lift the thigh as rapidly and as high as possible, while in the act of running to train the hip flexors.

For running exercises with distal leg/ankle weight applied the object is to first flex the knee joint as rapidly as possible and then extend the knee as rapidly as possible, while in the act of running. Furthermore, one may perform running exercises with both distal thigh and leg weights applied simultaneously.

Training of the vertical component of running focuses training on those muscles which are primarily responsible for the up and down motion that the body undergoes while in the act of running, the quadriceps and calf muscles. Training of the vertical component is performed with run specific motion of these muscles. This requires the use of a treadmill. The focus while training is to move the legs as rapidly as possible on the treadmill with the specific goal being to decrease the ground contact time for every step taken on the treadmill. Strengthening of this component, preferably while using the treadmill device, is achieved by increasing the vertical load on the athlete, which is achieved by adding weight to the athlete. An alternate embodiment allows for the use of some other resistance mechanism to increase vertical load, such as an elastic or motorized mechanism.

The effect of increasing vertical load onto an athlete causes an increase in ground contact time which may be offset by using a stabilizing frame placed around the treadmill. The purpose of the frame is for stabilization of the athlete who is subjected to an increased load, because stabilization allows the athlete to minimize ground contact time.

The vertical load be increased by any one of three possible methods. First, weights may be directly applied to the athlete by means of a waist belt to which weights are attached. This allows for the use of either off-the-shelf weighted plates or customized weighted objects or allows for the use of a weighted suit, weighted vest, weighted backpack, etc., to increase vertical load. Second, weights may be placed onto a weight-bearing frame. Here the increased load provided by the weights is transferred to the athlete by means of a waist belt, worn by the athlete, which is also attached to the weighted frame. Third, in addition to the use of weights, the waist belt may, in an alternate embodiment, be attached to some other form of resistance, such as elastic or motorized mechanism.

One waist belt useful for training the vertical component and the hip muscles of the horizontal component includes 1) the capability for attaching vertical load in any one of the three manners described above and 2) the capability for attaching any one of several different thigh harnesses, as described above under hip muscle strengthening. In an alternate embodiment multiple waist belts, each with their own harness, may be used. The waist belt may be further stabilized by the addition of shoulder straps.

The waist belt has adjustment capabilities for a wide variation of waist sizes. This includes the ability to slide or move the attachment site for both the thigh harnesses and vertical load bearing straps along the belt for proper positioning. Optional padding may be used on the inside of the waist belt for further comfort and/or stability.

Although the exercises are described as a run specific strengthening method, these may also be performed as general thigh and leg muscle conditioning, body-building or rehabilitation exercises.

Referring to the figures, a concentric contraction, FIG. 18A (large striped arrow shows direction of leg motion), is one where a muscle belly shortens, 1801, while the internal muscle fibers contract, 1802. In an eccentric contraction, FIG. 18B, a muscle belly lengthens, 1803, while the internal muscle fibers contract, 1804. A stretch-shortening is a rapid conversion of an eccentric to a concentric contraction, FIG. 18C. For example, if a limb is moving in one direction and that direction needs to be changed, an eccentric contraction first slows down movement in the original direction. When velocity of that motion reaches zero, a stretch-shortening occurs. The eccentric contraction converts to a concentric one. Subsequent movement of the limb is now in the opposite direction of the original one. In this way eccentric contractions slow or stop limb movements and concentric contractions accelerate or advance limbs in some direction.

The biomechanics of running divides the run cycle into two phases for each leg: swing and stance. The swing phase occurs when the leg is in the air. The stance phase of each leg occurs when it is in contact with the ground. In order to simplify the leg actions that occur, they can be divided into those that are responsible for horizontal movement of the body, forward progress, and those responsible for vertical movement, or, up and down motion.

Biomechanical analysis demonstrates that the muscles, which are most responsible for determining forward progress (horizontal movement) of the body during running, are the hip flexors and extensors. A simple model for the horizontal component of running, to help explain this, is to compare the motion of the leg to the spokes of a wheel, FIG. 19A. (This model works well because the wheel is in constant contact with the ground, thus there is no vertical motion to speak of) The spokes of a wheel rotate (FIG. 19A) completely around an axis, the axle. The speed of rotation of the wheel is determined by the power input at it's axle. In an analogous manner the leg also rotates around an axis. Here the axis is the hip joint, FIG. 19B. Unlike the wheel the hip does not completely rotate around 360 degrees. First, forward motion rotates the hip joint forward, and then backward around the hip joint. The primary muscles, which cause the forward thrust of the lower extremity, are the hip flexors (iliopsoas and rectus femoris muscles). They function in close association with the knee extensors (quadriceps muscles). The primary muscles, which cause the backward motion, are the hip extensors (upper hamstrings and gluteal muscles). Just as power input at the axle of a wheel determines speed of it's rotation, the power input at the axle of leg rotation, the hip joint, determines speed of leg rotation, hence leg speed, hence running speed. Thus, the muscles acting at the hip joint are most responsible for determining forward running speed.

An analysis of the swing and stance phases will demonstrate more closely what motions each leg goes through during the run cycle. As illustrated in FIG. 20, swing phase begins immediately after toe-off, A and B, the end of the prior stance phase. At the end of the prior stance and the onset of swing, A and B, the entire lower extremity, including the thigh, is moving backwards, thus, the hip is extending. The hip flexor muscles fire eccentrically to slow down this hip extension. Then a stretch-shortening of the hip flexors occurs and their subsequent concentric contraction causes hip flexion, B and C to occur. The thigh is thrust forward. A secondary effect of this hip flexion is hyper-flexion of the knee B, C and D. Then, when the knee approaches maximal hyper-flexion, D, the quadriceps muscle contracts eccentrically to slow down this knee flexion. Finally, a stretch-shortening of the quadriceps occurs, D, and it's subsequent concentric contraction causes extension at the knee joint, E.

In the latter half of swing phase the hip extensor muscles fire eccentrically, D, to slow down the rapid hip flexion. This is followed by a stretch-shortening of the hip extensors, D and E, and their subsequent concentric contraction results in extension of the hip joint, E and F. A secondary effect of this hip extension is to increase the rate of knee extension, which is also due to quadriceps contraction, as stated above. Immediately after hip extension begins the lower hamstrings (knee flexors) contract eccentrically, E and F, to slow down this rapid knee extension. Then, a stretch-shortening of the lower hamstrings occurs and their subsequent concentric contraction results in the onset of knee flexion. This occurs at the end of swing phase, F, coincident with the time of ground contact, or toe touch, the onset of stance phase.

Stance phase begins with ground contact, toe touch, and ends with toe-off, as illustrated in FIG. 21. With respect to the horizontal component, in this phase, lower extremity motion consists solely of continuous hip extension and knee flexion. The total range of knee flexion is relatively small. The knee rotates from 30 degrees of flexion at toe touch to around 50 degrees at toe-off (steps D and E in FIG. 21 do not adequately represent the flexion angle at toe-off during a maximal sprint).

In summary, the forward motion of the leg, hip flexion and knee extension, occurs through a double chain of events. First, the hip flexors fire causing forward motion of the thigh. This has a secondary effect of causing hyper-flexion of the knee. Immediately after hyper-flexion of the knee the quadriceps muscles contract to cause extension of the lower leg. Thus the muscle actions which determine forward progress of the lower extremity are the sequential contractions of the hip flexors followed by the knee extensors.

The backward motion of the leg is also a double chain of events. It begins with the contraction of the hip extensors, the secondary effect of which is to cause extension of the knee. Immediately after knee extension the lower hamstrings contract to cause flexion of the knee. Thus the muscle actions, which determine backward rotation of the extremity, are the sequential firing of the hip extensors, followed by the knee flexors.

Next, biomechanical analysis shows that the primary muscles acting in the vertical component of running are the quadriceps and calf (soleus and gastrocnemius) muscles. As opposed to the horizontal component, where significant muscle actions occur during both the swing and stance phases of the run cycle, in the vertical component (VC), significant muscle actions occur only during the stance phase. A simple model for the VC is a bouncing ball. (The ball, moving only in an up and down direction, has no horizontal component to speak of.)

During the swing phase the body moves first in an upward direction, caused by muscle actions in the latter half of the prior stance phase, and then in a downward direction. This downward momentum continues during the first half of stance phase. It must be slowed and reversed in order to prevent one from falling down. The quadriceps muscles, acting at the knee joint, contract eccentrically to absorb part of this downward force, which prevents "buckling" at the knee. Second, the calf muscles contract eccentrically to absorb a part of this downward force. The foot is in a plantar-flexed (pointed down) position at toe touch and if it were not for this contraction the heel would immediately drop and ankle support would collapse.

In the second half of stance phase the body is propelled upwards. During this half of stance phase the knee continues to flex, as was seen earlier, from 30 to 50 degrees. Because the knee continues to flex throughout stance phase the quadriceps muscle (a knee extensor muscle) contraction during this phase, by necessity, is an eccentric one. Hence, since it does not go through a stretch-shortening with a subsequent concentric contraction, the quadriceps muscle does not cause any of the upward motion of the vertical component. The calf muscles, on the other hand, contract eccentrically during the first half of stance phase, absorbing the downward momentum of the body. In the second half of stance they undergo a stretch-shortening and subsequent concentric contraction, which propels the body upward.

The principles of sport specific training would necessitate that these motions and muscle actions be replicated, that is, gradual knee flexion with simultaneous down and up motion of the body due to calf muscle action. The only way this motion could be properly duplicated and at the same time avoid horizontal, or forward, motion is with the use of a treadmill. A sport specific training method has been developed, based on the above horizontal and vertical component muscle actions and joint motions.

First, with respect to the horizontal component, to train these motions in a sport specific manner requires that the hip and knee motions mimic those motions, which occur in running while placing resistance against their movement. Again, the four muscle groups that are trained are the hip flexors and extensors and the knee extensors and flexors. The training method described herein involves first, training each of the above motions individually. This is followed by training the combinations of the actions described above, a) hip flexion—knee extension motions and b) hip extension—knee flexion motions. Furthermore, in order to best isolate the hip joint it is preferable that the torso and upper extremity be stabilized. This may be best accomplished by the use of a three-point stabilizing frame as shown in FIGS. 22A–22C and 23A–23C.

First, to train the hip flexors requires that resistance be placed at the distal thigh, such as by the application of a thigh weight, FIG. 22A, 2201, the first point of fixation. In order to use gravity the athlete places himself in a semi-reclined supine position on a frame, which has a chest pad, 2202, for torso "fixation", the second point of fixation. A lower back and/or seated pad, 2203, is the third point of fixation. The athlete allows the weight to fall with gravity, open arrow, 2204, which mimics the backward motion that the leg goes through at the onset of swing phase. The goal is then to resist further backward motion of the weight and follow with an immediate flexion of the hip, pushing the weight in an upward and forward direction, FIG. 22B, 2209. This trains the three types of muscle actions that the hip flexor muscles undergo: 1) an eccentric contraction, FIG. 22A, 2205, (slowing down the backward motion of the thigh) followed by 2) a stretch-shortening (sudden change in direction—change from an eccentric to a concentric contraction) and 3) the subsequent concentric contraction, FIG. 22B, 2211, (flexing the hip joint, which moves the thigh in a forward rotation or direction).

The next muscles to train are the knee extensors, quadriceps muscles. This is done with the athlete in the same position as for the hip flexion training. Here the athlete uses an ankle weight, 2212. Similar to the hip exercise, the athlete allows the weight to fall down, followed by hip flexion as above. However, here, the ankle weight, 2212, pulls the knee into hyper-flexion, 2213, as the hip is flexed, 2209. The athlete then places focus on resisting or stopping this knee flexion and converting it from a hyper-flexed knee position into knee extension, FIG. 22C, 2214. The quadriceps undergoes an eccentric contraction, FIG. 22B, 2215, followed by a stretch-shortening, followed by a concentric contraction, FIG. 22C, 2216.

The third exercise involves combining the above two exercises by using both thigh and ankle weights.

To train the hip extensors also requires that resistance be placed against the distal thigh. The athlete is now placed on a frame in an opposite direction as for hip flexion, a semi-recumbent prone position, FIG. 23A. Here, again, the thigh weight, 2201, is allowed to fall downward, FIG. 23A, 2317, which now mimics the forward rotation that the lower extremity undergoes during the swing phase. The goal is then to resist further downward motion of the weight and follow with an immediate extension of the hip, pushing the weight in an upward direction, 23B, 2318. This trains the three types of muscle actions that the hip extensor muscles undergo: 1) an eccentric contraction, FIG. 23A, 2319, followed by 2) a stretch-shortening and subsequent 3) concentric contraction, FIG. 23B, 2320.

The next muscles to train are the knee flexors, the lower hamstrings muscle group. This is done with the athlete in the same position as for hip extension training, but instead of a thigh weight the athlete uses an ankle weight, 2312. The weight is allowed to fall down, which causes the hip to flex, 2317, and the knee to extend, FIG. 23B, 2321, mimicking the actions that occur at the end of swing phase. As above, the athlete first resists this hip flexion and then converts it into hip extension, 2318. As the hip begins to extend, FIG. 23B, 2318, the ankle weight pulls the knee into further and more rapid extension, 23B,2321. The athlete then places focus on resisting and stopping this knee extension, which is a result of an eccentric hamstrings contractions, 2322. When the knee stops extending, the athlete then focuses on flexing the knee as rapidly as possible, FIG. 23C, 2323. This is a result of a concentric contraction of the hamstring muscle group, 2324. At the final phase of this exercise the hip is extending, FIG. 23C, 2318, and the knee is flexing, FIG. 23C, 2323. This trains the three types of muscle actions that the knee flexor muscles undergo: 1) an eccentric contraction, FIG. 23B, 2322, followed by 2) a stretch-shortening and subsequent 3) concentric contraction, FIG. 23C, 2324.

Just as for the hip flexion-knee extension combination, the athlete now progresses in training by combining these latter exercises, (sequential hip extension-knee flexion) by using both thigh and ankle weights.

An alternate embodiment of the above strengthening exercises, for both forward and backward leg rotation, uses some other resistance method in place of weights, such as an elastic resistance mechanism, such as elastic bands, elastic poles, motorized or electric resistance.

The number of reps, for both forward and backward leg rotation to be done is optional. However, in following sport specificity training principles, it is recommended that the number of reps to be done should be similar to the number of rotations a leg goes through for a particular race. For example, in training for the 100 m sprint the runner may take 30–40 steps. Thus, to train one leg properly, the athlete would perform a set of 15–20 reps. An alternative way to train is to perform as many sets as possible in the time it takes to run that race. In this way a 100 m sprinter would repeat as many reps as possible over a 10–12 second interval.

After these strengthening exercises are completed the athlete progresses the training to the use of weights while performing running exercises. This includes using thigh weights alone and combining thigh and ankle weights. In order not to change neural firing patterns it is recommended that, preferably, not more than 10% of normal weight be added. Thus, for a thigh that weighs 30 lbs., one would not use more than 3 lbs. of weight attached to the thigh.

For running exercises with a distal thigh weight applied, the object is to lift the thigh as rapidly and as high as possible, while in the act of running. The result is training of the hip flexor muscles. Hip extensor muscles, on the other hand, cannot be readily trained while running with distal thigh weight applied because the only way that those muscles would face any resistance is if the thigh moved from a straight up and down position to a 90° extended thigh position, a position, which is not easily attainable while running, rather easier to attain when in a prone or semiprone position.

For running exercises with distal leg/ankle weight applied, the object is to first flex the knee joint as rapidly as possible and then to extend the knee as rapidly as possible, while in the act of running. This acts to strengthen the knee flexors and extensors. Furthermore, these exercises may be performed on a treadmill, track, using hills or inclines, using ladder or hurdle devices, etc. In addition, one may perform running exercises with both distal thigh and leg weights applied simultaneously.

Next, the training method involves exercises for training the vertical component. As illustrated in FIG. 24, it involves a treadmill 2425, a surrounding weight-bearing frame 2476, and a mechanism by which to transfer the weight on the frame to an athlete who is on the treadmill. This consists of a strap, 2427, (ie. heavy-duty nylon) on each side of the frame, each with a ring clamp, 2428, which is attached to the athlete, who is wearing an appropriate waist belt, FIGS. 25 and 26, 2534.

The athlete trains by moving his legs as rapidly as possible on the treadmill, 2425, focus being placed on decreasing ground contact time. Vertical load is increased as needed, to progress in strengthening this component, by adding weight onto the frame on the weight-accepting bars, 2429. The weights are made stable by virtue of the frame. The athlete is further stabilized by grasping onto handles, 2430, attached to members of the frame, 2431.

The above discussion describes a sport specific training method. In order to implement this method requires a resistance device for the actual training. The following describes how a waist belt with six optional attachments can be applied to fulfill all the hip strengthening and the vertical component strengthening exercises. The use of an ankle strap with three optional resistance attachment mechanisms is used for strength training of the knee motions. Performance of these horizontal and vertical components requires specialized frames in order to be done properly. These frames were initially described in the prior mentioned patent applications.

Because the majority of the exercises to be performed require attachment of some mechanism to a waist belt, this will be described first. FIG. 25 illustrates a waist belt 2534. A preferred embodiment of the invention herein is for one waist belt to function in such a way so that it is capable of accepting multiple attachments, including three thigh harness options and three vertical loading options. An alternate option is to use a separate belt for each optional attachment device.

The waist belt as seen in FIG. 25 is preferably of heavy-duty material, such as reinforced nylon. It is adjustable to a wide variety of waist sizes. This is accomplished by any one of several options, one of which is demonstrated here with the use of a buckle, 2532, having multiple optional hole inserts, 2533. An alternate embodiment could, for example, utilize a hook and loop mechanism, reinforced with an overlapping loop of the belt. Embodiment of this invention includes the option of adding shoulder straps to the waist belt for further stability if needed. Suitable padding (padding not shown) on the entire inner lining of the waist belt is optional.

In FIG. 25 the waist belt, 2534, has reinforcements, 2535, in areas where weight will be attached. FIGS. 26 and 27 illustrate how the rigid ring, 2636, (i.e. made out of metal) is attached to a sliding mechanism, 2637, for the belt. The two rings, 2636, (only one is shown in the diagram) attach to the belt, 2534, one each on both sides by a heavy-duty (ie. reinforced nylon) strap 2638 wrapped preferably around and threaded through slits, 2639 in a semi-rigid plastic (or rubber) square plate, 2640. Optionally, a cushion, 2641, is placed inside of this plastic plate. The belt, 2534, is threaded, through the plate and strap assembly, 2637, one on each side. They, plates and strap, may slide, back and forth for optimal placement.

Figure 31A:
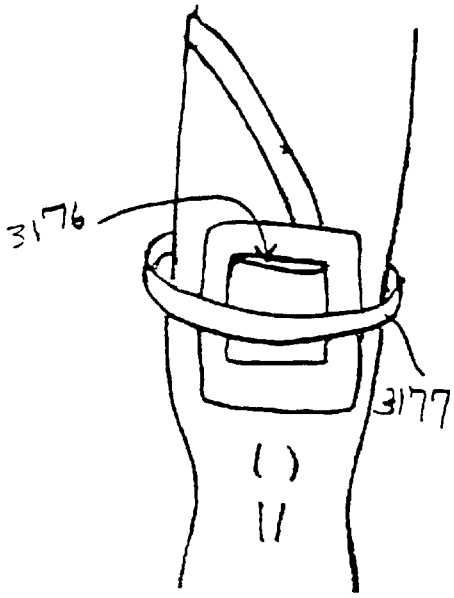
FIGS. 31A and 31B are views of an alternate mechanism for attaching weights to the thigh harness by the use of pockets, with or without the use of a strap for further stabilization.
Figure 31B:
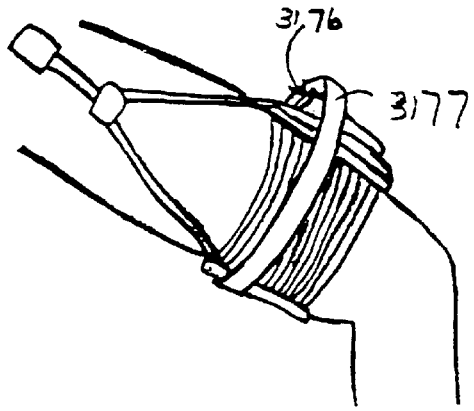

There are three possible thigh harnesses, which attach to the metal ring, 2636. The first one, FIGS. 28, 29 and 30, attaches heavy weights for performing heavy resistance strength training (HRT) exercises. The second one, FIGS. 31A and 31B, is for applying relatively lighter weights to allow the athlete to perform running exercises with resistance placed at the distal thigh. The third one, FIGS. 32A and 32B, allow the athlete to attach an alternate resistance mechanism, such as the use of a cable to connect the distal thigh to: a) a motorized resistance or b) an elastic band or c) elastic poles.

With respect to a thigh harness for performing HRT, options include using off-the-shelf dumbbells, weighted plates or customized weights. Weighted plates are less preferred due to their bulk in size, but may be attached by a strap or clamp mechanism to the thigh harness. Customized weights would do well, but due to an increase in cost they may be less preferred.

FIGS. 28 and 29 demonstrate one embodiment for the attachment of off-the-shelf dumbbell weights, including loads that are over 100 lbs., to a thigh harness, which is attached to a belt. FIGS. 29 and 30 are side views of the thigh harness. Straps 2843 and 2844 are front and back thigh straps for providing vertical support of the weights. These straps, 2843 and 2844, attach to front, 2845, and back, 2846, rigid plates, which overly cushioned pads, 2847 and 2848. Although they may be statically sewn or clamped to the plates, preferably they are attached by a mechanism which allows the straps to slide, side to side, as demonstrated by the end of the strap, 2843, looped around a metal ring, 2849, and strap 2844 wrapped around metal ring 2850, where the looped ends of the straps are sewn onto themselves. The metal rings, 2849 and 2850, are securely attached to the rigid plates, 2845 and 2846.

Figure 33:
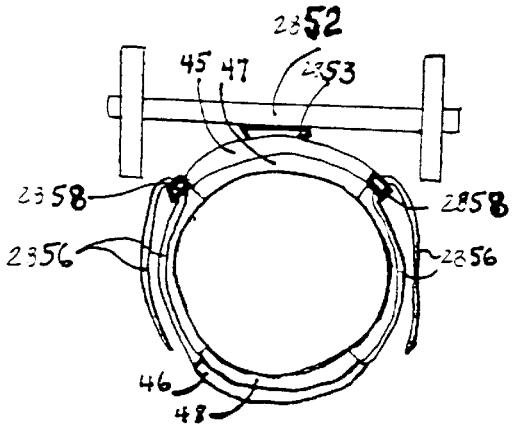
FIG. 33 is a cross-section view of the thigh with attached dumbbell weight, lying on a thigh plate, with securing straps attached to a posterior plate.
Figure 34A:
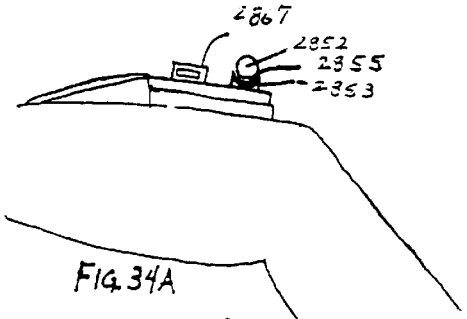
FIGS. 34A and 34B are side views of two options for an adapter mechanism, on the front part of the plate, which the dumbbell handle is meant to rest on or rest against.
Figure 34B:
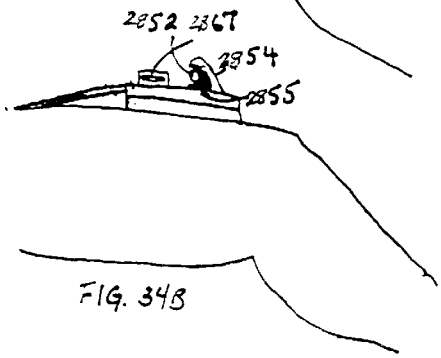

The mid-portion or handle of the dumbbell weight, 2852, is placed onto a rigid (i.e. metal or hard plastic) adapter, 2853, which is attached to the front thigh plate, 2845. The plate, 2845, is contoured. See FIG. 33. The pad, 2847, under the rigid plate, 2845, may be made of, but not limited to, a foam rubber or gel-foam, or a pressure distributing air cell material. The handle, 2852, is typically between 12–15 cm in length and 3 cm in diameter. Because the plate, 2845, is rounded and the dumbbell handle, 2852, is straight an adapter, 2853, is built onto, or added onto, the plate. This is preferably 4–5 cm in length, allowing for a 4–5 cm strap to be wrapped around the dumbbell handle, 2852, on opposite sides of the adapter,.2853. The adapter itself may be semi-circular, with the open end facing forward, relative to the thigh as in figure FIG. 34A, or it may face upward as in FIG. 34B. Preferably a hard but elastomeric rubber or plastic interface is placed on the semi-circular adapter, 2855. This is to prevent scraping and/or scratching that would occur if a metal dumbbell handle were placed directly onto a metal or hard plastic adapter. The adapter interface, 2855, is shaped as in FIG. 34A or 34B to conform to the adapter shape. The inner diameter of this lining is preferably slightly larger than the diameter of the dumbbell handle, allowing for an easy fit. An alternate embodiment would place a groove within the plate such that an adapter would not be needed. This groove is also preferably lined with rubber or plastic material.

The front plate, 2845, is attached to a back plate, 2846, which, also has an underlying pad, 2848, by straps, 2856. These straps, 2856, may be tightened around the thigh by threading the straps around a loop/clamp, 2858, attached to the front plate. Alternatively one side may be elastic and only the opposite side would have the capacity for tightening (i.e. only one adjustment-this option is not shown). The straps are preferably as wide as the length of the metal plates for better distribution of stress. The strap may attach to itself by a hook and loop method or buckle, etc.

Figure 35A:
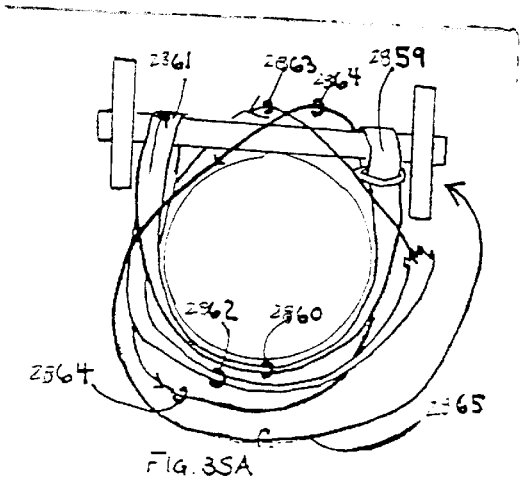
FIGS. 35A and 35B demonstrate a cross section and frontal view of a manner, by which to wrap a strap around the thigh in order to secure a dumbbell weight, which rests against the harness plate.
Figure 35B:
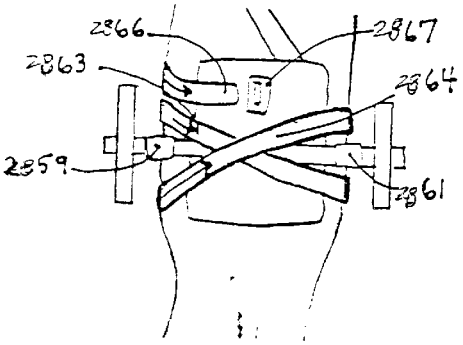
Figure 40A:
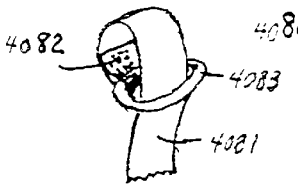
FIGS. 40A and 40B depict a manner by which to make a loop using a strap and metal ring.
Figure 40B:
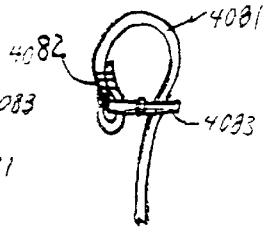

After the dumbbell is placed onto the metal plate it needs to be secured to the plate. One embodiment involves the use of clamps (ie. as in ski boots—not shown). An alternative involves the use of a strap, FIGS. 35A and 35B, made out of reinforced nylon, wrapped first around the dumbbell handle on one side of the adapter. The strap is first looped around itself, 2859. The loop is demonstrated in FIGS. 40A and 40B. It is then pulled behind the thigh, across the posterior plate, 2860, and then around the opposite side of the dumbbell handle, 2861. Next, the strap is looped back around the posterior thigh a second time, 2862. It is then crossed over the handle in front, 2863. It is then wrapped around the posterior thigh a third time, 2864. And, again, around the front of the handle, 2852, perpendicular, 2864, to the first crossing, 2863. It is finally wrapped a fourth time around the posterior thigh, 2865. After wrapping the belt around in this fashion the end of the strap, 2866, is secured to a buckle or clamp, 2867, situated on the front plate superior to or above the adapter. In one embodiment the dumbbell weight is secured in front for performing both hip flexion and extension exercises. An alternate embodiment places weight in front for hip flexion and in back for hip extension exercises. Finally, yet another embodiment reverses this latter one, where weight is placed in front for hip extension and in back for hip flexion. In this third option, the weights essentially hang either behind or in front of the knee—they are "pulled". In the second option, the weights are "pushed".

Next, the thigh harness straps, 2843, and 2844, attach to provide an "axis, FIG. 28, 2868, which is to be centered with the axis of rotation of the hip. The center of hip rotation is shown in FIG. 28, where the hip axis 2869 is located at the level of the tip of the greater trochanter, 2870, the palpable bony prominence at the lateral upper aspect of the femur bone.

The axis, 2868, may be a metal ring, 2871, as in FIGS. 30, 29, 36A or 36B, or it may be the strap, 2873 and 2875, between rings 2836 and 2871. In this embodiment both straps, 2843 and 2844, are looped around the metal ring, 2871, allowing them to slide, to some degree, backward and forward.

Figure 36A:
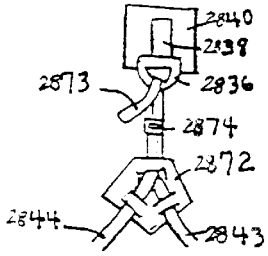
FIGS. 36A and 36B are two options for adjusting vertical length in order to align the hip center of rotation with that of the thigh harness straps.
Figure 36B:
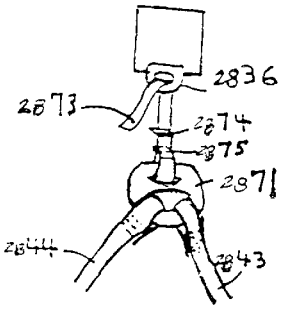

FIG. 36A demonstrates an alternate embodiment where straps 2843 and 2844 are weaved through a semi-rigid (ie. rubber or plastic) hexagonal flat square, 2872. Here the straps do not slide backward or forwards because they are fixed by the placement through slits in the hexagon. At the upper aspect both straps pass through the same slit to exit superiorly. Here one end of the strap loops around the ring of the belt. Vertical length may be altered by pulling more or less of the strap through a buckle or clamp mechanism, 2874. FIG. 36B demonstrates how alignment may be altered with a third strap, 2875, which loops around the upper horizontal member of the semi-circular ring, 2636, and is fixed to itself. The free end, 2873, loops around the belt ring and length is adjusted by pulling more or less of the strap through a buckle or clamp mechanism, 2874. These two mechanisms allow centering axis 2868 with the hip center of rotation.

These two vertical adjustments are but two possible ways to apply the thigh harness. Embodiments of the invention herein allow for yet an alternative mechanism, including cables, rigid metal or plastic rods, pants suit, etc. in place of the nylon straps.

The second type of thigh harness utilizes lighter weights. Because these are worn while performing running exercises, dumbbell weights are not practical. A lighter amount of weight, usually 1–6 lbs., is used. The weights must be securely fastened to prevent them from bouncing around excessively during a running exercise. One embodiment, FIGS. 31A and 31B, involves the use of pockets, 3176, for inserting off-the-shelf weighted plates, 1,2 or 2½ lbs. etc. A second option is the use of customized weights, inserted into pockets. These are secured to avoid bouncing around such as with a strap, 3177, wrapped around them and the thigh. FIGS. 31A and 31B show such a device where pockets are placed on the front of the thigh. Alternately, back pockets may be used. Embodiments of the invention allow for some other mechanism, besides pockets, to secure the weights. Furthermore, the invention herein includes the use of the thigh harness in FIGS. 28, 29, or 30, where custom or weighted plates are attached for running and secondly the option of using entirely separate units for HRT vs. for running exercises.

Figure 32A:
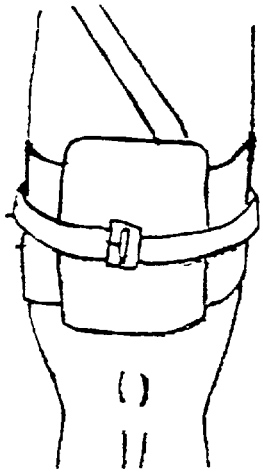
FIGS. 32A and 32B are views of one manner in which to attach an alternate resistance mechanism to the distal thigh, preferably by the use of a cable.
Figure 32B:
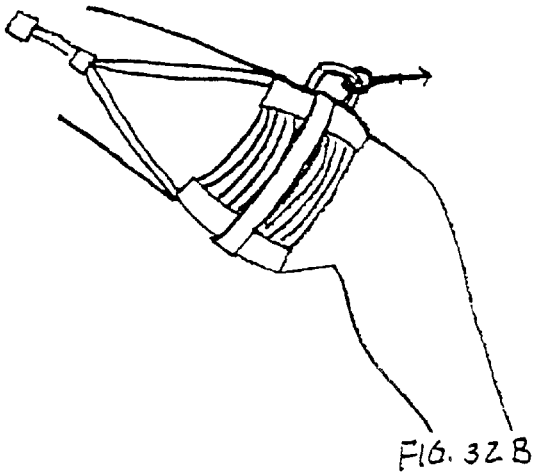

FIGS. 32A and 32B demonstrate one embodiment for attaching resistance to the distal thigh by an alternate resistance mechanism. An alternate embodiment would use a different thigh harness. This includes use of only a thigh wrap, because vertical support and straps, 2843 and 2844, would not be absolutely necessary.

A waist belt may be used to train the vertical component of running. FIG. 24 shows where a waist belt would attach to the weight bearing frame, 2426, by virtue of straps 2427 and ring clamps, 2428. These straps, 2427, are looped around the horizontal bars, 2429, of the frame, 2426, also the place where weighted plates are to be applied, 2429. For ease of attaching to the waist belt ring, 2636, a rigid ring clamp, 2428, (i.e. metal) with a spring-loaded hinge is preferably used.

A second embodiment allows for weighted plates to be attached to the belt rings, FIGS. 25 and 26, 2636, by a strap or strap with clamp mechanism (not shown). When the athlete uses this option instead of the above option, it is still necessary for a surrounding frame to be used in order that athlete may grasp onto handle, 2430, the goal being to stabilize the athlete such that ground contact time may be minimized.

A third option is to attach the waist belt rings to a cable, which is attached to an alternate resistance mechanism, such as an elastic band, elastic poles, pneumatic/hydraulic, motorized or electric mechanisms.

Next, a set of devices is described which applies resistance at the ankle in order to allow one to strength train the knee flexor and extensor muscles. There are three different ankle attachment options. One for applying heavy weights for HRT, one for applying light weights for running exercises and one for attachment to an alternate resistance mechanism.

Figure 37:
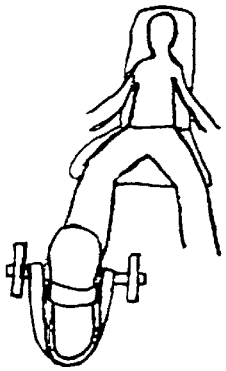
FIG. 37 is a frontal view of someone performing a knee extension with an ankle weight attached.
Figure 38A:
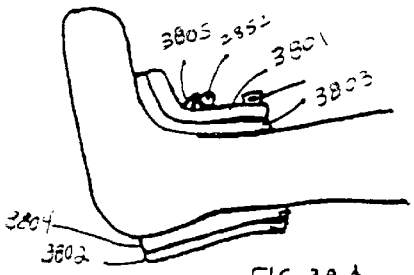
FIG. 38A is a side view of a dumbbell weight lying on a frontal 'L' shaped ankle plate.

FIG. 37 shows an athlete performing a leg extension exercise. Here, the athlete is using a dumbbell weight secured to option one above for performing HRT exercises. FIG. 38A shows a side view of one half of the ankle weight-securing device (the other half is a strap described in the following paragraph). It consists of a rigid plate in front, 3801, and a rigid plate in back, 3802, of the ankle. Underneath each plate is a pad in front, 3803, and in back, 3804, to cushion the underlying skin. Note the front piece is preferably in the shape of a "lazy-L", which conforms to a 90 degree flexed position of the foot. A curved lip, 3805, is attached to the front plate for accepting the handle of a dumbbell weight, 3852. Lip options are the same as was described for the thigh pad, FIGS. 34A and 34B. This includes the use of a rubber or plastic lining, onto which the dumbbell handle comes into contact.

Figure 38B:
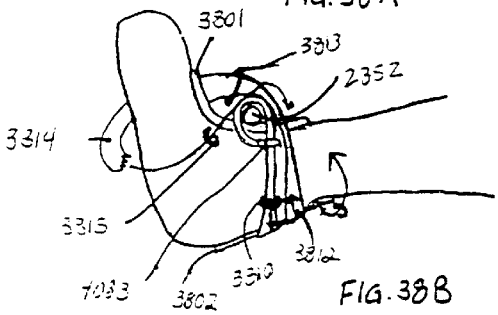
FIG. 38B is a side view of a manner, by which to wrap a strap around a left ankle and foot in order to secure a dumbbell weight.
Figure 39:
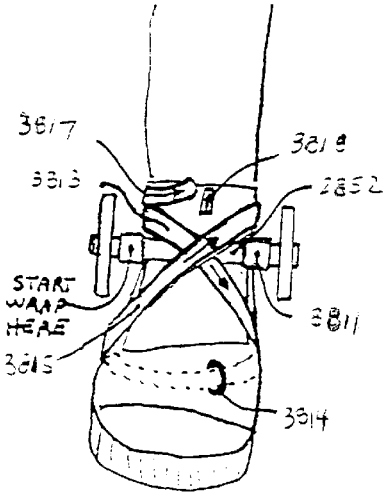
FIG. 39 is a front view of a manner, by which to wrap a strap around a Right ankle and foot in order to secure a dumbbell weight.

The weight is best stabilized when it is secured around both the ankle and the foot. As for the thigh weight, a heavy-duty nylon strap 4081 (4–5 cm width) is a good option. For the left ankle the wrapping is begun as in FIG. 38B. The strap is looped through a double slit, ring or square, 4083, FIG. 40A, (rigid ie. metal or heavy plastic.) One end of the strap is looped through one slit and sewn onto itself, 4082. The free end of the strap passes through the other open slit, forming a loop, through which one half of the dumbbell handle is wrapped around, FIGS. 38B and 39. The strap then passes behind the ankle 3810. It then is wrapped over and around the opposite side of the dumbbell handle, 3811. Next, it is passed back around and behind the ankle 3812. Now, as seen in FIG. 39 it is then crossed in front, 3813, of the dumbbell handle, 3852, and around the sole of the foot, 3814. After it comes around the foot is crosses the handle perpendicular, 3815, to the first crossing, 3813. Finally, it is looped, again, around the back of the ankle, 3816. After it comes around to the front, 3817, it is secured by a clamp or buckle, or loop and hook, 3818, etc.

In one embodiment the dumbbell weight is secured in front for performing both knee flexion and extension exercises. An alternate embodiment places weight in front for knee extension and in back for knee flexion exercises. Finally, yet another embodiment reverses this latter one, where weight is placed in front for knee flexion and in back for knee extension exercises.

All patents and patent applications disclosed herein, including those set forth in the Background of the Invention, are hereby incorporated by reference. Although the present invention has been described with reference to preferred embodiments, workers skilled in the art will recognize that changes may be made in form and detail without departing from the spirit and scope of the invention. In addition, the invention is not to be taken as limited to all of the details thereof as modifications and variations thereof may be made without departing from the spirit or scope of the invention.

What is claimed is:

1. A training method for athletes, comprising the steps of:

positioning portions of the athlete's body on both sides of a joint in a three point stabilization system;

centering an axis of rotation of the joint with an axis of rotation of an actuator;

sequentially performing acceleration training on the joint supramaximally against the actuator through a sports specific motion; and sequentially performing stretch-shortening cycle training on the joint supramaximally against the actuator through a sports specific motion.

2. The method of claim 1 wherein the step of sequentially performing acceleration training supramaximally comprises the step of training against a hydraulic resistance or a rotary hydraulic resistance using a sports specific motion.

3. The method of claim 1 wherein the step of sequentially performing stretch-shortening cycle training of the joint supramaximally comprises the step of training against isotonic resistance using a sports specific motion.

4. The method of claim 1 wherein the steps of sequentially training the joint supramaximally using a sports specific motion comprises the step of sequentially training the joint supramaximally using a combination of isotonic and hydraulic resistance.

5. The method of claim 1 wherein the step of positioning comprises applying a stabilizing harness to the athlete.

6. The method of claim 5 wherein the step of applying the stabilizing harness to the athlete further comprises the step of applying shoulder straps to the athlete or applying a waist strap to the athlete.

7. The method of claim 1 wherein the step of supramaximally training the joint comprises the step of progressively increasing the load on the actuator.

8. The method of claim 1 wherein the step of supramaximally training the joint comprises the step of achieving maximum joint speed.

9. The method of claim 1 wherein the step of positioning portions of the athlete's body on both sides of the joint in a three point stabilization system comprises the steps of:

engaging at a first contact point a portion of the athlete's body with the actuator distal to the axis of rotation of the joint;

supporting at a second contact point a portion of the athlete's body at or near the axis of rotation and on the opposite side of the limb as the first contact point; and supporting at a third contact point a portion of the athlete's body proximal the axis of rotation and on the same side as the first contact point.

10. The method of claim 1 wherein the joint is selected from one of the wrist, elbow, shoulder, waist, neck, ankle, knee or hip.

11. The method of claim 1 wherein the step of sequentially performing acceleration training comprises performing acceleration training concentrically.

12. The method of claim 1 wherein the step of sequentially performing stretch-shortening cycle training comprises rapidly converting an eccentric contraction to a concentric contraction.

13. A training apparatus for athletes, comprising:

a three point stabilization system adapted to isolate and stabilize portions of the athlete's body on both sides of a joint;

an actuator having an axis of rotation centered at an axis of rotation of the joint;

a first resistance device adapted to perform acceleration training on the joint supramaximally against the actuator through a sports specific motion; and a second resistance device adapted to perform stretch-shortening cycle training on the joint supramaximally against the actuator through a sports specific motion.

14. The apparatus of claim 13 wherein the first resistance device is a hydraulic device or a circular hydraulic device.

15. The apparatus of claim 13 wherein the second resistance device is isotonic.

16. The apparatus of claim 13 wherein the first and second resistance devices can be coupled to the actuator simultaneously.

17. The apparatus of claim 13 comprising a stabilizing harness.

18. The apparatus of claim 17 wherein the stabilizing harness comprises one or more shoulder straps or one or more waist straps.

19. The apparatus of claim 13 wherein the three point stabilization system comprises:

a first contact point on the actuator adapted to engage with a portion of the athlete's body distal to the axis of rotation of the joint;

a second contact point adapted to engage with a portion of the athlete's body at or near the axis of rotation of the joint and on the opposite side of the athlete's body as the first contact point; and a third contact point adapted to engage with a portion of the athlete's body proximal the axis of rotation of the joint and on the same side as the first contact point.

20. The apparatus of claim 13 wherein the three point stabilization system is adapted to isolate and stabilize one of the wrist joint, elbow joint, shoulder joint, waist, neck, ankle joint, knee joint or hip joint.

21. The apparatus of claim 13 wherein the first resistance mechanism provides concentric resistance.

22. The apparatus of claim 13 wherein the second resistance mechanism provides eccentric resistance.

23. The apparatus of claim 13 wherein the first and second resistance devices comprises discrete resistance devices.

24. The apparatus of claim 13 comprising an adjustment mechanism to center the axis of rotation of the actuator with the axis of rotation of the joint.

25. The apparatus of claim 13 comprising one or more electronic sensors adapted to provide feedback for one or more of force, range of motion, acceleration, maximum velocity, and number or repetitions.

26. A training method for athletes that separates running into vertical and horizontal components, comprising the steps of:

positioning the athlete in a semi-reclined position on a horizontal component training device which has a three-point fixation capabilities;

applying resistance to the athlete's distal thigh and distal ankle;

sequentially performing hip flexor muscle training by performing reps against the distal thigh resistance in a run specific motion;

sequentially performing knee extensor muscle training by performing reps against the distal ankle resistance in a run specific motion;

sequentially performing combined hip flexor and knee extensor muscle training by performing reps against both the distal thigh and distal leg /ankle resistances in a run specific motion;

positioning the athlete in a semi-prone position on a horizontal component-training device, which has a three-point fixation capabilities, applying resistance to the athletes distal thigh and distal ankle;

sequentially performing hip extensor muscle training by performing reps against the distal ankle resistance in a run specific motion;

sequentially performing knee flexor muscle training by performing reps against the distal ankle resistance in a run specific motion;

sequentially performing combined hip extensor and knee flexor muscle training by performing reps against both the distal thigh and distal ankle resistances in a run specific motion;

sequentially performing running exercises with resistance attached to the distal thigh to lift the thigh as rapidly and as high as possible, such that the hip flexor muscles are strengthened;

sequentially performing running exercises with resistance attached to the distal ankle to flex the knee joint as rapidly as possible and to extend the knee as rapidly as possible such that the knee flexor and extensor muscles are strengthened;

positioning the athlete on a vertical component training device comprising a treadmill and stabilizing frame;

attaching the athlete to a stabilizing frame;

applying a vertical load onto the athlete; and training at least the quadriceps and calf muscles of the athlete on the treadmill using a run specific motion.

27. The method of claim 26 further comprising the steps of:

rotating the athlete 90 degrees from either the horizontal or vertical position;

sequentially performing training of at least the hip abductor and the hip abductor muscles of each leg against either distal thigh, distal leg/ankle or both distal thigh and leg/ankle resistance.

28. The method of claim 26 wherein the distal thigh and ankle resistance comprises attached weights, elastic bands, elastic poles, elastic springs, weight loading apparatus, isokinetic resistance apparatus or electromagnetic resistance apparatus.

29. The method of claim 28 wherein the method of applying weights to the distal thigh is accomplished by a thigh harness that stabilizes and secures the weights to the thigh.

30. The method of claim 28 wherein the method of applying weights to the distal ankle is accomplished by an ankle harness that stabilizes and secures the weights to the ankle.

31. The method of claim 26 wherein the step of attaching the athlete to the stabilizing frame comprises the step of applying a stabilizing harness to a waist region of the athlete.

32. The method of claim 26 wherein the step of applying the vertical load onto the athlete comprises the step of applying vertical load to the waist region of the athlete.

33. A waist belt apparatus adapted to at least three different thigh harnesses and three different vertical loading fitting.

34. The waist belt apparatus of claim 33 wherein the thigh harness straps, when attached to the waist belt, have length adjustment capabilities, such that their center of rotation aligns with the center of rotation of the hip joint, thereby preventing up and down movement of the thigh weights with hip flexion and extension.

* * * * *